US006692799B2

(12) United States Patent
Waller, Jr.

(10) Patent No.: US 6,692,799 B2
(45) Date of Patent: Feb. 17, 2004

(54) MATERIALS AND METHODS FOR CREATING WATERPROOF, DURABLE AQUEOUS INKJET RECEPTIVE MEDIA

(76) Inventor: Clinton P. Waller, Jr., 2101 Birch St., White Bear Lake, MN (US) 55110

( * ) Notice: Subject to any disclaimer, the term of this patent is extended or adjusted under 35 U.S.C. 154(b) by 0 days.

(21) Appl. No.: 10/295,506

(22) Filed: Nov. 15, 2002

(65) Prior Publication Data

US 2003/0152753 A1 Aug. 14, 2003

Related U.S. Application Data

(63) Continuation of application No. 09/591,655, filed on Jun. 9, 2000, now abandoned.

(51) Int. Cl.[7] ..... B41M 5/00; B32B 5/12; B32B 27/14; B32B 27/06

(52) U.S. Cl. ..... 428/32.23; 428/32.24

(58) Field of Search ..... 428/195, 109, 428/483, 32.23, 32.24

(56) References Cited

U.S. PATENT DOCUMENTS

| | | | | |
|---|---|---|---|---|
| 4,048,271 | A | 9/1977 | Kesting | 264/41 |
| 4,090,662 | A | 5/1978 | Fayling | 235/493 |
| 4,247,498 | A | 1/1981 | Castro | 264/41 |
| 4,371,582 | A | 2/1983 | Sugiyama et al. | 428/341 |
| 4,384,047 | A | 5/1983 | Benzinger et al. | 521/64 |
| 4,396,643 | A | 8/1983 | Kuehn et al. | 427/160 |

(List continued on next page.)

FOREIGN PATENT DOCUMENTS

| | | | | |
|---|---|---|---|---|
| DE | 30 24 205 | A1 | 1/1982 | |
| EP | 0 233 703 | A2 | 8/1987 | |
| EP | 0 350 257 | A1 | 1/1990 | |
| EP | 0 380 133 | A1 | 1/1990 | |
| EP | 0 484 016 | A1 | 5/1992 | |
| EP | 0 716 931 | A1 | 6/1996 | |
| EP | 0 718 384 | A2 | 6/1996 | |
| EP | 0 802 245 | A1 | 10/1997 | |
| EP | 0 904 953 | A1 | 3/1999 | |
| JP | 61-41585 | | 2/1986 | |
| JP | 61-261089 | | 11/1986 | |
| JP | 11-296658 | | 10/1999 | |
| WO | WO 88/06532 | | 9/1988 | |
| WO | WO 92/07722 | | 5/1992 | |
| WO | WO 93/01938 | | 2/1993 | |
| WO | WO 95/06564 | | 3/1995 | |
| WO | WO 95/30547 | | 11/1995 | |
| WO | WO 97/07991 | | 3/1997 | |
| WO | WO 97/15457 | | 5/1997 | |
| WO | WO 98/05512 | | 2/1998 | |
| WO | WO 98/29516 | | 7/1998 | |
| WO | WO 99/10184 | | 3/1999 | |
| WO | WO 99/509902 | * | 7/1999 | H01L/21/68 |
| WO | WO 99/45375 | | 9/1999 | |
| WO | WO 99/55537 | | 11/1999 | |
| WO | WO 99/56682 | | 11/1999 | |
| WO | WO 00/00352 | | 1/2000 | |
| WO | WO 00/47421 | | 8/2000 | |

*Primary Examiner*—Bruce Hess
*Assistant Examiner*—L. Ferguson
(74) *Attorney, Agent, or Firm*—Melissa E. Buss

(57) ABSTRACT

An imageable media is disclosed. An imageable media in accordance with the present invention comprises a substrate having a first surface and a porous layer overlaying the first surface of the substrate. In a preferred embodiment, for pigmented inks, a plurality of ink retaining silica particles are disposed within the porous layer. After inkjet imaging with pigmented ink, the porous layer may be fused to create a durable, tamper and scuff resistant, waterproof graphic without a laminate. In another preferred embodiment for dye based inks, a plurality of zeolite particles and a plurality of cross-linked polyvinylpyrrolidone particles are disposed within the porous layer. The porous layer may be imbibed with an ink retention coating for dye based inks. Imageable media made with this invention has utility for commercial graphics, labels and ID cards.

21 Claims, 8 Drawing Sheets

U.S. PATENT DOCUMENTS 4,419,388 A 12/1983 Sugiyama et al. ..... 427/288
4,429,015 A 1/1984 Sheptak ..... 428/201
4,442,172 A 4/1984 Oshima et al. ..... 428/342
4,451,582 A 5/1984 Denzinger et al. ..... 521/38
4,452,843 A 6/1984 Kaule et al. ..... 428/199
4,460,637 A 7/1984 Miyamoto et al. ..... 428/212
4,496,629 A 1/1985 Haruta et al. ..... 428/341
4,503,111 A 3/1985 Jaeger et al. ..... 428/195
4,539,256 A 9/1985 Shipman ..... 428/315.5
4,595,931 A 6/1986 Toganoh et al. ..... 346/1.1
4,613,441 A 9/1986 Kohno et al. ..... 210/500.36
4,630,891 A 12/1986 Li ..... 350/105
4,649,064 A 3/1987 Jones ..... 427/256
4,701,837 A 10/1987 Sakaki et al. ..... 346/135.1
4,726,989 A 2/1988 Mrozinski ..... 428/315.5
4,732,786 A 3/1988 Patterson et al. ..... 427/261
4,749,084 A 6/1988 Pereyra ..... 206/459
4,775,594 A 10/1988 Desjarlais ..... 428/421
4,781,985 A 11/1988 Desjarlais ..... 428/421
4,812,352 A 3/1989 Debe ..... 428/142
4,830,902 A 5/1989 Plantenga et al. ..... 428/207
4,833,172 A 5/1989 Schwarz et al. ..... 521/62
4,861,644 A 8/1989 Young et al. ..... 428/195
4,867,881 A 9/1989 Kinzer ..... 210/490
4,892,779 A 1/1990 Leatherman et al. ..... 428/220
4,900,620 A 2/1990 Tokita et al. ..... 428/330
4,930,814 A 6/1990 Nusmeier ..... 283/109
4,935,307 A 6/1990 Iqbal et al. ..... 428/500
4,935,401 A * 6/1990 Pendergrass, Jr. ..... 503/206
4,954,395 A 9/1990 Hasegawa et al. ..... 428/318.4
4,966,804 A 10/1990 Hasegawa et al. ..... 428/203
4,968,063 A 11/1990 McConville et al. ..... 283/72
4,986,868 A 1/1991 Schmidt ..... 156/249
5,027,131 A * 6/1991 Hasegawa et al. ..... 346/1.1
5,059,983 A 10/1991 Higuma et al. ..... 346/1.1
5,060,981 A 10/1991 Fossum et al. ..... 283/109
5,068,140 A 11/1991 Malhotra et al. ..... 428/216
5,084,340 A 1/1992 Light ..... 428/327
5,102,731 A 4/1992 Takimoto et al. ..... 428/323
5,118,570 A 6/1992 Malhotra ..... 428/474.4
5,120,594 A 6/1992 Mrozinski ..... 428/195
5,126,195 A 6/1992 Light ..... 428/327
5,134,198 A 7/1992 Stofko, Jr. et al. ..... 525/205
5,139,598 A 8/1992 Chou et al. ..... 156/234
5,141,797 A 8/1992 Wheeler ..... 428/195
5,192,617 A 3/1993 Stofko, Jr. et al. ..... 428/411.1
5,198,306 A 3/1993 Kruse ..... 428/481
5,206,071 A 4/1993 Atherton et al. ..... 428/195
5,208,092 A 5/1993 Iqbal ..... 428/195
5,219,928 A 6/1993 Stofko, Jr. et al. ..... 525/57
5,241,006 A 8/1993 Iqbal et al. ..... 525/196
5,277,811 A 1/1994 Moya ..... 210/500.3
5,302,436 A 4/1994 Miller ..... 428/195
5,302,437 A 4/1994 Idei et al. ..... 428/195
5,326,619 A 7/1994 Dower et al. ..... 428/164
5,336,558 A 8/1994 Debe ..... 428/323
5,342,688 A 8/1994 Kitchin et al. ..... 428/402
5,370,763 A 12/1994 Curiel ..... 156/277
5,374,475 A 12/1994 Walchli ..... 428/304.4
5,376,727 A 12/1994 Iqbal et al. ..... 525/196
5,380,044 A 1/1995 Aitkens et al. ..... 283/67
5,389,723 A 2/1995 Iqbal et al. ..... 525/57
5,407,893 A 4/1995 Koshizuka et al. ..... 593/227
5,410,642 A 4/1995 Hakamatsuka et al. ..... 395/113
5,422,178 A 6/1995 Swenson et al. ..... 428/343
5,429,860 A 7/1995 Held et al. ..... 428/195
5,435,599 A 7/1995 Bernecker ..... 283/70
5,443,727 A 8/1995 Gagnon ..... 210/490
5,462,708 A 10/1995 Swenson et al. ..... 264/174.11
5,464,254 A 11/1995 Campbell et al. ..... 283/109
5,472,789 A 12/1995 Iqbal et al. ..... 428/483
5,534,320 A 7/1996 Raby ..... 428/42.1
5,537,137 A 7/1996 Held et al. ..... 347/105
5,545,280 A 8/1996 Wenz ..... 156/234
5,569,529 A 10/1996 Becker et al. ..... 428/331
5,589,259 A 12/1996 Hosoi et al. ..... 428/323
5,591,527 A 1/1997 Lu ..... 428/411.1
5,595,403 A 1/1997 Garrison ..... 283/74
5,599,765 A 2/1997 Ohshima et al. ..... 503/227
5,629,093 A 5/1997 Bischof et al. ..... 428/411.1
5,658,411 A 8/1997 Faykish ..... 156/233
5,660,919 A 8/1997 Vallee et al. ..... 428/206
5,681,660 A 10/1997 Bull et al. ..... 428/500
5,683,774 A 11/1997 Faykish et al. ..... 428/40.1
5,686,602 A 11/1997 Farooq et al. ..... 536/101
5,688,738 A 11/1997 Lu ..... 503/227
5,707,722 A 1/1998 Iqbal et al. ..... 428/304.4
5,710,588 A 1/1998 Malhotra ..... 347/153
5,721,086 A 2/1998 Emslander et al. ..... 430/126
5,747,148 A 5/1998 Warner et al. ..... 428/212
5,756,188 A 5/1998 Reiter et al. ..... 428/195
5,766,398 A 6/1998 Cahill ..... 156/240
5,786,298 A 7/1998 Tsou et al. ..... 503/227
5,795,425 A 8/1998 Brault et al. ..... 156/235
5,807,461 A 9/1998 Hagstrom ..... 156/361
5,811,493 A 9/1998 Kent ..... 525/92 F
5,830,561 A 11/1998 Hagner ..... 428/195
5,837,351 A 11/1998 Chernovitz et al. ..... 428/195
5,837,365 A 11/1998 Chung ..... 428/318.8
5,837,375 A 11/1998 Brault et al. ..... 428/411.1
5,846,647 A 12/1998 Yoshino et al. ..... 428/328
5,858,514 A 1/1999 Bowers ..... 428/195
5,874,145 A 2/1999 Waller ..... 428/42.1
5,890,742 A 4/1999 Waller ..... 283/67
5,928,789 A 7/1999 Chen et al. ..... 428/413
5,939,469 A 8/1999 Fussnegger et al. ..... 523/161
5,952,104 A 9/1999 Sugiyama et al. ..... 428/409
5,958,564 A 9/1999 Iwamoto et al. ..... 428/212
5,965,256 A 10/1999 Barrera ..... 428/354
5,969,069 A 10/1999 Su et al. ..... 526/318
5,976,671 A 11/1999 Gleim ..... 428/172
6,001,482 A 12/1999 Anderson et al. ..... 428/409
6,080,261 A 6/2000 Popat et al. ..... 156/240
6,124,417 A 9/2000 Su ..... 526/318
6,165,593 A 12/2000 Brault et al. ..... 428/195

* cited by examiner

MATERIALS AND METHODS FOR CREATING WATERPROOF, DURABLE AQUEOUS INKJET RECEPTIVE MEDIA

This is a continuation of copending application Ser. No. 09/591,6551 filed on Jun. 9, 2000, now abandoned.

FIELD OF THE INVENTION

The present invention relates generally to imageable media. More particularly, the present invention relates to image retaining media for such things as identification cards.

BACKGROUND OF THE INVENTION

A laminate in accordance with the present invention may be utilized for such things as identification cards. Identification cards and related products have been used for many years as a means for persons to establish their identity and credentials. These identification cards may include a number of images.

One popular method of imaging identification cards has been through the use of a printing process known as diffusion dye thermal transfer (D2T2). In this printing process, heat is utilized to cause a colored dye to migrate into a layer of the card construction. This process in described in commonly assigned U.S. Pat. No. 5,688,738 entitled Security Card and Method for Making Same. Despite its obvious utility, the D2T2 imaging process is a relatively expensive one, both in the cost associated with the equipment to perform this process, and the cost associated in the required printing ribbons. When a particular organization produces a large number of cards, there is a large incentive to keep the cost of each card low.

With the advent of low cost, high quality inkjet printers, there has been a great deal of interest in ink-jet printing security cards. Inkjet techniques have become vastly popular in commercial and consumer applications. The ability to use a personal computer and desktop printer to print a color image on paper or other receptor media includes both dye-based and pigment-based inks. The latter provide more durable images because pigment particles are contained in a dispersion before being dispensed using a thermal or piezo inkjet print head from inkjet printers.

Typically, pigment based ink systems have found use in wide-format inkjet printers for outdoor or back lighted sign applications. The extra durability of the pigments is required to prevent fading from extended exposure to UV light. Because of the typical size of the imaged graphic and intended viewing distance of the graphic, the resolution of the graphic need not be a photo realistic rendition. In addition, the wide format graphics need good color saturation, which can be provided by higher ink delivery volumes. Typical wide format printers have resolutions from about 180 to 600 drops per inch (dpi) and dispense 30 to 140 picoliters of ink per drop.

The desk top inkjet printers have diverged from the wide format printers because of the intended use. Photo images now can be digitally made and stored on magnetic media, optical disks, or computer memory. There is demand to be able to print photo realistic graphics at home or office quickly and economically. Because of simplicity of operation, economy of inkjet printers, and improvements in ink technology, the inkjet imaging process is satisfying that demand. To get the continuous tone appearance required for photo realistic graphics, some inkjet printer manufacturers have offered printers that have higher resolution, smaller drop volumes, and additional colors. Now, a typical desk top inkjet printer can have resolution to 1440 dpi and drop volumes as low as 3 picoliters. In addition, some inkjet printers jet more than the standard cyan, yellow, magenta, and black (CYMK) colors. Additional colors such as light cyan and light magenta have been added to increase the effective resolution by changing the dithering patterns formerly required. These types of improvements to inkjet printers have lowered the total amount of required ink used and closed the image quality gap, enabling images produced by inkjet printers to now be capable of competing with images made by thermal dye transfer printing technology. Also, a nice feature of aqueous inkjet printers is that the printers can work in home and office environments, whereas the solvent based inkjet systems with emissions cannot.

The water present in aqueous ink solutions is a source of various technical difficulties. Aqueous solutions are slow to dry, sensitive to humidity, and susceptible to deterioration by water soaking. Excess water can cause image distortion and bleeding of the image. When an image is printed on a card substrate, excess water can reduce or prevent bonding between the layers of the card, which in turn can lead to problems with delamination and/or tampering. Excess water may also cause bubbling of the card during lamination.

Suitable receptor media has not existed for the security card industry for inkjet printing because of the high application demands placed on the card. Current inkjet media usually contains water swellable coatings, binders, or absorbing pigments, such as all forms of silica, alumina, zeolites, methylcellulose, polyvinyl alcohol, and the like. If particles such as zeolite particles are used, the particles are usually bound together in a system that is binder deficient. If too much binder is used, no inter particle porosity would be obtained. If not enough binder is used, the particles could fluff off like powder from the printing surface. Great care is given to the binder to particle ratios in order to reap benefits of porous media and, until now, this has been one of the only practical ways to achieve an ink-jet printable surface. These particles are needed because the inkjet ink itself can be aqueous. Media with these types of materials can be inherently slow to dry, are sensitive to humidity, prone to delaminating in the layer containing a high concentration of particles and delaminating and damage from external water soaking. Hence, the current commercially available paper or film coating technologies do not work for ID cards and have not been made available for that application. Furthermore, the current inkjet receptor media is not sufficiently durable to withstand scratching and the wear and tear placed on a ID card. To prevent this wear and tear, the graphic printed on the current media may be laminated with a protective plastic layer that is coated with pressure sensitive adhesives. Some inkjet receptor media coating have been made to be used without a laminate to withstand wear and tear, however, they tend to be too brittle for flexible cards. These coatings may also not be waterproof enough to prevent ink transfer. Laminates with hot melt adhesives exist and can be applied to inkjet generated images but must be laminated after the image is completely dry, to eliminate gas bubbles from the water and other volatile ink components upon heating. Also, the current media does not have the look and feel of credit cards that consumers are used to and, therefore, the current media would have to be attached to a stiffer substrate adding more potential delamination.

Japanese Patent No. 11129685A discloses an ID card and methods to print ID cards without ink to the edges in order to avoid the problem of the inkjet ink causing delaminating problems. However, many card issuers have applications where they want the aesthetics of edge to edge printing.

U.S. Pat. No. 5,928,789 discloses the need to essentially glue the ink receptive layer to a substrate again underscoring the difficulties in permanently attaching an inkjet receptive surface.

U.S. Pat. No. 5,443,727 discloses materials and a method for printing on a porous media and subsequently fusing the pores shut thereby encapsulating the image This art requires the porous film to be laminated to a substrate for support because it is not formed as an integral part of the substrate.

U.S. Pat. No. 4,384,047 discloses a process for membrane formation using vinylidene fluoride polymer. This patent teaches the need to control the casting solution temperature and humidity above the coating knife and subsequent washing steps to create a wrinkle free film which is in sharp contrast to the simplicity of the current invention's process.

U.S. Pat. No. 4,496,629 discloses a coating layer that can be described as micro-cracks which contain zeolites or synthetic zeolites and other inorganic particles. The ratio of binder to particles is 1:20 to 1:5.

U.S. Pat. No. 3,615,024 teaches how to make skinned membranes. They use harsh solvents and low solid concentrations in the coating solution when using polyvinyl chloride. Also a water wash step is required.

U.S. Pat. No. 4,048,271 discloses a Dry Process for solvent phase inversion membranes. The disclosure of this patent underscores the need for higher molecular weight polymers for phase inversion for free standing films, whereas the integral casting on a substrate of this invention allows the use of lower molecular weight polymers.

European Patent Application No. EP 0 904 953 A1 uses a system of bonding PVC particles to one another to form porosity.

U.S. Pat. No. 5,374,475 discloses the need of perpendicular pores formed out of colloidal suspensions or the use of a nonporous layer underneath the pores to absorb ink in order to be an effective ink receptor. The art also does not permit the use of particles or filler materials.

SUMMARY OF THE INVENTION

An imageable media is disclosed. An imageable media in accordance with the present invention comprises a substrate having a first surface and a porous layer overlaying the first surface of the substrate. In a useful embodiment, a plurality of particles are disposed within the porous layer. It should be noted that in another preferred embodiment, there is no particular order or arrangement to the particles. In another preferred embodiment, a plurality of zeolite particles are disposed within the porous layer. In a particularly preferred embodiment a plurality of zeolite particles and a plurality of cross-linked polyvinylpyrrolidone particles are disposed within the porous layer.

An imageable media in accordance with the present invention may be utilized to fabricate identification cards, driver's licenses, passports, and the like. In a preferred embodiment, the image receptive material is adapted to receive an image comprised of aqueous ink. In a particularly preferred embodiment, the image receptive material is adapted to receive an image comprised of aqueous pigmented ink adapted for use in an inkjet printer. A printed image in accordance with the present invention preferably includes one or more security indicia. Examples of security indicia that may be suitable in some applications include a picture of a human face, a representation of a human finger print, barcodes, and/or a representation of a cardholder's signature.

The imageable media printed with dye ink is rendered tamper, water and scuff resistant, by hot fusion with a laminate. In a preferred embodiment the imageable media printed with pigmented ink is rendered tamper and scuff resistant, waterproof, and outdoor durable by simple heat sealing without adhesives, hot melts, coatings, or laminates.

DETAILED DESCRIPTION OF THE PREFERRED EMBODIMENTS

The following detailed description should be read with reference to the drawings, in which like elements in different drawings are numbered in like fashion. The drawings which are not necessarily to scale, depict selected embodiments and are not intended to limit the scope of the invention. Examples of constructions, materials, dimensions, and manufacturing processes are provided for various elements. Those skilled in the art will recognize that many of the examples provided have suitable alternatives which may be utilized.

Figure 1:
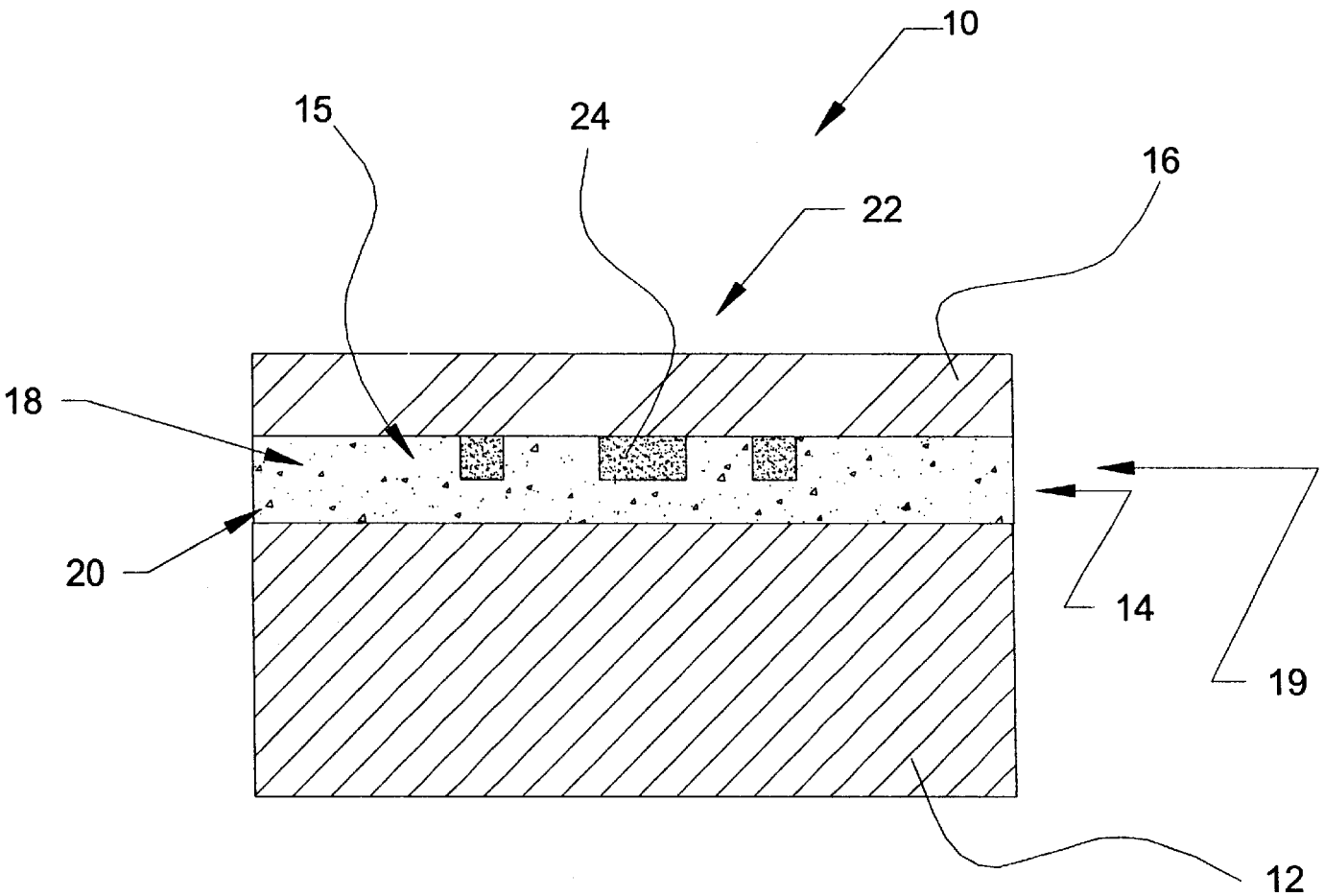
FIG. 1 is a highly diagrammatic cross-sectional view of a multi-layered structure in accordance with the present invention.

FIG. 1 is a highly diagrammatic cross-sectional view of a multi-layered structure 10 in accordance with the present invention. Multi-layered structure 10 includes a substrate 12, an ink retention system 14, and an over-layer 16 disposed on one side of substrate 12. Ink retention system 14, and overlayer 16 can also simultaneously be placed on the opposite side of substrate 12. In the embodiment of FIG. 1, an ink retention system 14 comprises a porous structure 15 defining a plurality of pores (not shown) and a plurality of particles 18 and a plurality of granules 20 which are disposed within porous structure 15. Ink retention system 14 of FIG. 1 includes an ink retention coating 19. In a preferred embodiment for use with dye based inks, the ink retention coating 19 is imbibed into recessed surfaces of porous structure 15. Also in a preferred embodiment, ink retention coating 19 renders porous structure 15 hydrophilic.

A printed image 22 comprising an ink 24 is disposed on/in ink retention system 14. In a preferred embodiment, ink 24 comprises an aqueous ink. In a particularly preferred embodiment, ink 24 comprises an aqueous ink adapted for use in an inkjet printer. Multi-layered structure 10 is preferably utilized in conjunction with an inkjet printer to produce identification cards, driver's licenses, passports, and the like. Printed image 22 preferably includes one or more security indicia. Examples of security indicia that may be suitable in some applications include a picture of a human face, a representation of a human finger print, barcodes, and/or a representation of a human signature. It should be noted that applying heat and pressure may advantageously crush the porous structure layer 15 without inducing image defects to printed image 22.

The Porous Structure

Figure 2:
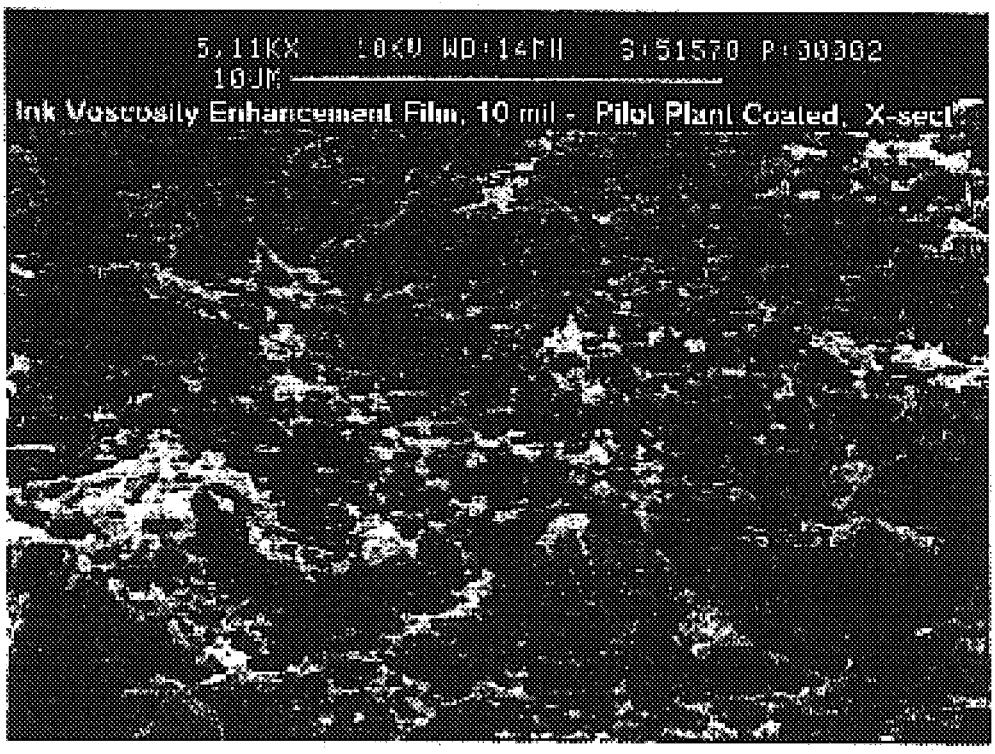
FIG. 2 is a micrograph of a structure in accordance with an exemplary embodiment of the present invention, in this figure the structure is magnified about 5000 times.
Figure 3:
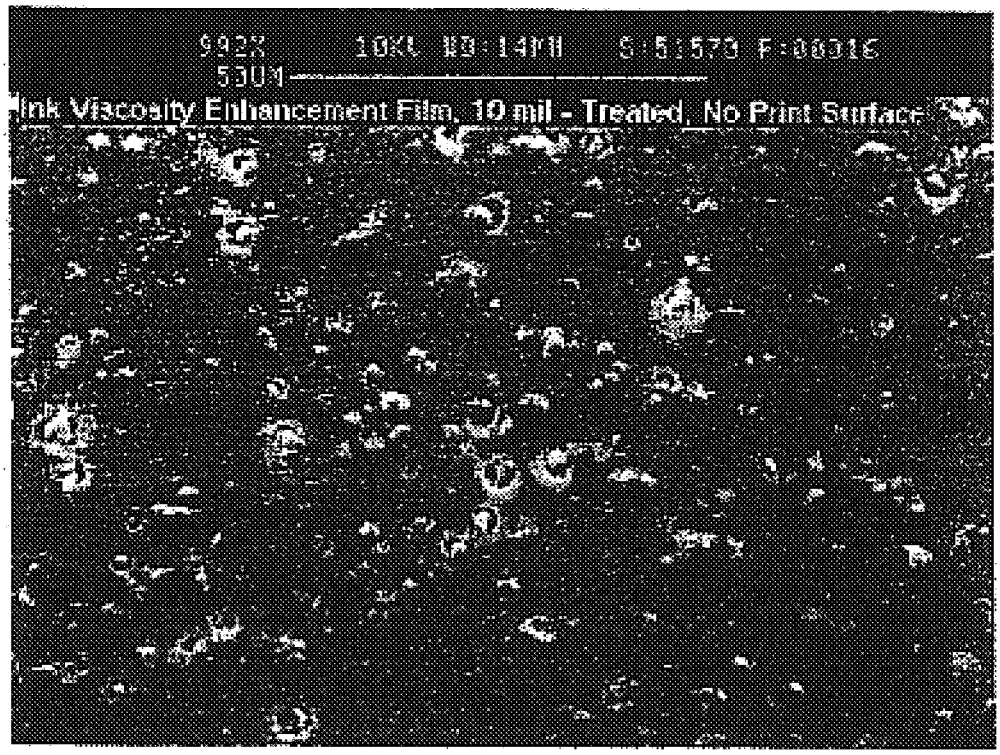
FIG. 3 is a micrograph of a structure in accordance with an exemplary embodiment of the present invention, in this figure the structure is magnified about 1000 times.

As described above, ink retention system 14 comprises a porous structure 15 defining a plurality of pores. FIGS. 2 and 3 are scanning electron microscopic (SEM) photographs of an exemplary porous structure in accordance with the present invention. The pores defined by the porous structure are readily visible in FIGS. 2 and 3. In the embodiment of FIGS. 2 and 3, pluralities of particles are disposed within the porous structure. Pluralities of granules are also disposed within the porous structure.

In a preferred embodiment, the particles are comprised of cross-linked polyvinyl pyrrolidone (PVP). In this preferred embodiment, the diameter of the PVP particles is between about 1 and about 20 microns. Also in a preferred embodiment, the granules comprise zeolite. The term zeolite refers to various hydrous aluminum silicate minerals and their corresponding synthetic compounds. Zeolites, which may be suitable in some applications, are commercially available from PQ Corporation of Valley Forge Pa. In a preferred embodiment, the diameter of the zeolite granules is between about 3 and about 6 microns. A sample identification card comprising a porous layer including zeolite granules and cross-linked polyvinylpyrrolidone particles yielded surprising results when subjected to a water challenge test. These surprising results are demonstrated by Examples 4–7. Neither the LUVICROSS M particles, zeolites, or Poly[(vinylpyrrolidone)$_x$(Acrylic Acid)$_y$(Dimethylaminoethyl methacrlate methyl chloride)$_z$] polymer by themselves in the porous matrix would stop ink migration when the graphic was water challenged. Surprisingly, the combination of zeolites and the Poly [(vinylpyrrolidone)$_x$(Acrylic Acid)$_y$(Dimethylaminoethyl methacrlate methyl chloride)$_z$] polymer stopped ink migration when the graphic was water challenged.

A porous structure in accordance with the present invention is preferably, though not necessarily, formed by dry casting on a substrate. The porous structure can be made by first preparing a casting dope. Various embodiments of casting dope may be utilized without deviating from the spirit and scope of the present invention. Examples of the casting dope preferred physical state include a homogeneous solution, a heterogeneous solution of molecular aggregates, or a very fine colloidal suspension. Casting dopes in accordance with the present invention are stable or metastable for extended periods of time under normal storage conditions.

The casting dope is preferably heated to obtain solution. The casting dope is heated to a temperature at or above about 60° C. for about one hour. The heated solution becomes clear and when cooled to ambient temperature, it retains one of the aforementioned physical states. This simple step is fundamental to obtaining solutions that contain higher polymer concentrations with mixed molecular weights. Lower molecular weight polymers may not phase separate properly, yet are better suited for heat sealing. Higher molecular weight polymers are easily phase separated, yet have a harder time flowing together from heat and pressure to seal and they tend to thicken the casting solution to a gel like consistency at lower concentrations. Optionally, the casting dope may be subjected to agitation to speed the process. Methods of agitation, which may be suitable in some applications, include stirring, shaking, and sonication.

The solid components (e.g., particles) of the casting dope are preferably added to the casting dope after the liquid components have been heated and cooled to ambient temperature. This method is presently preferred because it enhances the visual inspection of the liquid components during mixing, etc. If the solids are added at an earlier time they may cloud the casting dope resulting in a degraded ability to visually inspect the quality of the casting dope during preparation. Particles in the casting dope may settle over time however, the particles can be suspended again within the casting dope by stirring or mixing.

Scuff and scratch resistance properties can be enhanced by the addition of thermal plastic particles that can be capable of film forming and/or binding ink. This is particularly important for products made for use without the addition of a protective laminate. A particular class of materials that improves those toughness properties is polyester copolymers with Shore Hardness of 35D or higher. More preferably, polymer particles with a Shore Hardness above 65D are useful. These are sold commercially by Bostik under the trade name Vitel. Preferably, the particles are formed in-situ by adding them to the casting dope solution from a solution of 30% Vitel and 70% MEK. The particles naturally form when the two solutions at ambient temperature are mixed and there agitated by stirring or shaking. This operation is best performed before other particles such as the silica, zeolites, or other particles are added.

Preferably, a dry casting method is utilized to form a porous structure. A method in accordance with the present invention may include the step of applying the casting doped to a substrate. Various processes may be utilized to apply the casting dope to the substrate without deviating from the spirit and scope of the present invention. Examples of processes, which may be suitable in some applications, include coating, pump metering dipping, spraying, and pouring.

A casting dope in accordance with the present invention may be applied to a substrate at ambient temperature and humidity, and in an ambient (e.g., air) atmosphere Casting at ambient temperature and humidity and in an ambient environment may be preferred in some applications because it eliminates the need for equipment to control temperature, humidity, and atmosphere at the casting station (i.e. at the point where the pores are starting to be formed above the cast web).

A method in accordance with the present invention preferably includes the step of dispersing the casting dope across the substrate. Various methods of dispersing the casting dope across the substrate may be utilized without deviating from the spirit and scope of the present invention. Examples of methods which may be utilized in some applications include they use of a Mayer rod, an air knife, notch bar coater, and a doctor blade. The casting dope is preferably applied to the substrate at a wet thickness of about 0.3 millimeters, which dries down to about 0.04 millimeters thick. The preferred porous recording layer has a dry weight of about 16 grams/m$^2$. The porosity is preferred above 50%, and more preferably above 70% void volume. The void volume is preferably set with good accuracy by the ratio of polymer to non-solvent in the system an indicator that the pore surface is properly made.

To facilitate drying, the substrate may be fed through an oven or dryer after the casting dope is dispersed. The oven temperature profile may be selected to allow for a desired surface structure to develop. Altering the solvents of the system can enhance the speed of the structure forming solvent evaporating process. Thus, the effective line speed of the drying process and resulting surface structure formation can be controlled with faster evaporating solvents and slower evaporating non-solvents. The temperature in the first zone in the drying oven is set at ambient temperature with mild air impingement to allow the primary gel of the porous layer to develop properly. The next oven zones can have increased temperatures and air impingement. The temperatures are usually set just below the glass transition temperature of the porous polymer matrix. Some solvents (non-solvents) can be removed from the porous surface by evaporation at an elevated temperature but at a temperature below the solvent's boiling point.

This Dry Cast technique can be then repeated on the reverse side of the selected substrate. In the ID card application, the result would be a card that is printable on both sides. Magnetic stripes, found on the backside of many credit and bankcards, can also be installed directly on the porous coating. The magnetic stripe is applied onto the porous coating the same way as any conventional card. (The portion of the card with the stripe is then not printable, or desired to be so.)

Porous surfaces created in accordance with the present invention may have a brilliant white appearance. In a preferred embodiment, almost all the light is uniformly reflected across the visual spectrum. Porous surfaces created in accordance with the present invention have a relatively low absorbtance and a relatively high reflectance. Notably, the low absorbtance characteristics of the present invention are present in the difficult low wavelength (e.g., violet-blue) regions.

Absorbtance, (optical density) is the ratio of the radiant energy absorbed by a body to that which is incident upon it. The mathematical expression for absorbtance may be written $$A=-Log_{10}(I_R/I_S)$$

Where $I_R$ is the intensity of light transmitted from the object and $I_S$ is the intensity of the source light.

A porous surface in accordance with the present invention may have utility as a diffuse reflector. The porous surface may be applied to various substrates and articles using various application processes. Processes that may be suitable in some applications include dipping, spraying, rolling, and painting. Because the reflective porous surface may be applied directly, there is not a need to cut and or fit a reflective film to fit the shape of the article.

A porous surface in accordance with the present invention may also be advantageously utilized on clear film as a receptor for back-lit graphics. The porous structure will uniformly disperse light reducing or eliminating lighting hot spots. A porous surface in accordance with the present invention may be used for reflecting light in conjunction with various applications requiring diffuse reflection. Examples of such diffuse reflective articles include back-lit liquid crystal displays, lights, projection system displays, white standards, photographic bounce lights, and the like.

Particles and Granules

In the embodiment of FIGS. 1 through 3, ink retention system 14, includes a plurality of particles 18 and a plurality of granules 20. Particles 18 and granules 20 may be utilized to manage ink absorption, prevent distortion from lamination, prevent ink migration, prevent surface skinning, eliminate blushing, and increase or decrease the casting dope viscosity.

In a presently preferred embodiment, granules 20 comprise zeolite. Also in a presently preferred embodiment, particles 18 comprise cross-linked polyvinylpyrrolidone particles. As stated previously, a sample identification card comprising a porous layer including zeolite particles and cross-linked polyvinylpyrrolidone particles yielded surprising results when subjected to a water challenge test. These surprising results are discussed further in Examples 4–7 below.

Cross-linked polyvinylpyrrolidone particles may be utilized to absorb synthetic of natural dyestuffs including dyes such as azo dyes, azamethine dyes, and triphenylmethane dyes.

It should be understood that the use of zeolite granules and cross-linked polyvinylpyrrolidone particles does not restrict the use of additional particles Embodiments of the present invention are possible in which porous layer 15 includes additional materials in particle and/or granule form. Examples of materials which may be suitable in some applications include calcium carbonate, fumed silica, precipitated silica alumina, alkyl quaternary ammonium bentonite, alkyl quaternary ammonium montmorillonite, clay, kaolin, talcum, titanium oxide, chalk, bentonite, aluminum silicate calcium silicate, magnesium carbonate, calcium sulfate, barium sulfate, silicium oxide barium carbonate, boehmite, pseudo boehmite, aluminum oxide, aluminum hydroxide diatomaceous earth, calcined clay, and the like. Additional particles may serve various functions including ink retention. Examples of particle functions include pigmentation filling, lubricating, ultraviolet light absorption, whitening, heat stabilizing, and the like.

Because of the highly porous nature of the ink receptive layer, very low amounts of the ink receptive particles are required to enable good inkjet images to be generated. This has the advantage of the ability of the surface to seal from heat and pressure because the porous matrix becomes the binder after fusion. Commercial inkjet coatings generate interstitial porosity from particle spacing using low binder ratios. The unique porous matrix of this invention avoids this situation by allowing the particles to be dispersed Furthermore, water swellable or soluble ink receptive polymers are needed when using pigmented ink. This allows greater penetration of the ink into the porous matrix and subsequently, virtually immediate workable dry times are achieved (i.e. rubber transport rollers can be used vs. star wheels on the printed media exit of the printer.) It is believed that the media in this invention will enable new advances in inkjet printer hardware and software configurations. The trend in the printer hardware industry is to make print heads with more nozzles and fire them at higher frequencies, and produce higher image resolutions. Checking the patent archives we can find U.S. Pat. No. 4,266,232 (Koepcke, et. al. 1981) a Voltage Modulated Drop-on-Demand Ink Jet Method and Apparatus that could fire at 25,000 drops per second. Many commercial printers to this day fire at less than 10,000 drops per second. Faster computers and these types of printer improvements are likely. Printing an ID card sized media edge to edge may require a first set of card transport rollers to push the card under the print head. Then the transport mechanism must have a second set of rollers after the print head grip and pull the card through under the inkjet print head so the last part of the card can be imaged. This means without print margins the transport rollers will have to grab the printed part of the card almost immediately after it is printed. Obviously, if the printing is still wet, damage to the image could occur or ink could transfer to the transport rollers.

The time after printing before heat sealing can begin, and the dwell time during heat sealing are also critical issues for rapid generation of ID cards. Example 13 exemplifies the rapid printing and sealing achievable using this invention. Sealing with a hot roller has the unexpected advantage of allowing the ink colorant vehicle to evaporate out of the porous matrix before the surface seals enabling this operation to occur without time delay or predrying of the card.

Printed Image

In a preferred embodiment, ink retention system 14 is capable of easily receiving a printed image comprising aqueous ink because of porous structure 15. In a preferred method, the image is printed onto ink retention system 14 utilizing an inkjet printing process. Other printing processes may be utilized without deviating from the spirit and scope of the present invention. Examples of printing processes, which may be suitable in some applications, include gravure printing, offset printing, silk screen printing, and flexographic printing.

A printed image in accordance with the present invention preferably includes one or more security indicia. Examples of security indicia that may be suitable in some applications include a picture of a human face, fingerprint, a background pattern, a representation of a cardholder's signature, holograms, pearlescent ink, retro reflective ink or the like. Security indicia may be utilized to overtly verify or covertly verify that the printed item is authentic. A laminate in accordance with the present invention may be utilized in the fabrication of identification card's etc. having one or more security indicia.

The formation of precise inkjet images is provided by a variety of commercially available printing techniques. Non-limiting examples include thermal inkjet printers such as DeskJet brand, PaintJet brand, Deskwriter brand, DesignJet brand, and other printers commercially available from Hewlett Packard Corporation of Palo Alto, Calif. Also included are piezo type inkjet printers such as those from Seiko-Epson, Raster Graphics and Xerox, spray jet printers and continuous inkjet printers. Any of these commercially available printing techniques introduce the ink in a jet spray of a specific image on the medium of the present invention.

Many types of inks may be utilized in conjunction with the present invention. Examples of inks that may be suitable in some applications include organic solvent-based inks, water-based inks, thermo inks, UV curable inks, phase change inks, and radiation polymerizable inks. Inks utilizing various colorants may be utilized in conjunction with the present invention. Examples of colorants, which may be suitable in some applications, include dye-based colorants and pigment based colorants.

Substrate

Substrate 12 may comprise a number of commercially available materials. In a presently preferred embodiment, substrate 12 comprises a thermoplastic material. Substrate 12 may comprise many thermoplastic and non-thermoplastic materials without deviating from the spirit and scope of the present invention. Examples of thermoplastic materials that may be suitable in some applications include polyethylene (PE), polypropylene (PP), polyvinylchloride (PVC), polyvinyl chloride-co-vinyl acetate (PVC/VA,) polyethylene terephthalate (PET), polyethylene terephthalate glycol (PETG), terephthalic acid ethylene glycol cyclhexane dimethonal copolymer, acrylic, polyimide, polyamide, and thermoplastic polyurethane. Examples of non-thermoplastic material that may be suitable in some applications include thermoset polyurethane.

It is generally preferred that the material from which the substrate is formed be compatible with the material comprising the phase separated porous surface to augment binding of the substrate and phase separated porous surface. For example, a phase separated porous surface comprised of PVC/VA can be combined with a substrate comprised of PVC, PVC/VA, or PETG. Likewise, a phase separated porous surface comprised of polystyrene can be combined with a substrate comprised of high impact polystyrene. Typical commercial ID cards are made of polycarbonate, PET, PETG, PVC, PVC/VA, polystyrene, ABS, polyester, or high impact polystyrene.

Referring to FIG. 1, different embodiments of structure 10 are possible for example a tie layer can be disposed between system 14 and substrate 12. Embodiments of multi-layered structure 10 have also been envisioned which include a sheet of tie material interposed between system 14 and over-layer 16. The tie layer may comprise various materials without deviating from the spirit and scope of the present invention. Examples of tie materials which may be suitable in some applications include polyvinyl chloride (PVC)/vinyl acetate copolymers, acid/acrylate modified ethylene vinyl acetate (EVA), and acid/anhydride-modified polyethylene. Acid/acrylate modified ethylene vinyl acetate is commercially available from E. I. du Pont de Nemours and Company of Wilmington, Del. which identifies this material with the trade name BYNEL. Acid/anhydride-modified polyethylene is commercially available from Equistar Chemicals LP of Houston, Tex. that identifies this material with the trade name PLAXAR. This would allow the porous layer to be vastly different from the substrate and still maintain tamper-indicating adhesion between the layers for secure ID card applications. Blends of the Acid/acrylate modified ethylene vinyl acetate and BYNEL resins are useful for attaching PVC/VA porous system 14 to substrates 12 made of polypropylene, polyethylene, or their copolymer blends.

Over-layer

In a presently preferred embodiment, over-layer 16 is comprised of an optically transparent film. Embodiments of over-layer 16 are possible in which over-layer 16 includes a tie layer. In an identification card, over-layer 16 may be utilized to enhance and protect the images of the identification card.

In a preferred embodiment, over-layer 16 is heat laminated to system 14. The porous nature of the present invention allows for some of the volatile components in the ink to be expressed out of the card during the laminating process. Other methods may be utilized to fix over-layer 16 to system 14 without deviating from the spirit and scope of the present invention. For example, over-layer 16 may be fixed to system 14 using an adhesive.

A preferred laminate is one that is finctional with the porous coating and/or the ingredients of the ink retention system. For example, if the porous coating includes poly (vinyl chloride-co-vinyl acetate-co-maleic acid), a preferred laminate may comprise a 60%/40% blend of poly(vinyl chloride-co-vinyl acetate-co-maleic acid) and Poly(vinyl chloride-co-vinyl acetate) or a copolyester resin sold under the trade mange of VITEL available from Bostik Incorporated of Middleton, Mass. In a particularly preferred embodiment, the overlayer has about the same glass transition temperature and molecular weight as the porous coating.

In a preferred embodiment the thickness of over-layer 16 is between about 6.35 micrometers and about 203.2 micrometers. In a more preferred embodiment, the thickness of over-layer 16 is between about 25.4 micrometers and about 101.6 micrometers.

Embodiments of over-layer 16 are possible in which over-layer 16 includes a tie layer. Embodiments of multi-layered structure 10 have also been envisioned which include a sheet of tie material interposed between system 14 and over-layer 16. The tie layer may comprise various materials without deviating from the spirit and scope of the present invention. Examples of tie materials which may be suitable in some applications include polyvinyl chloride (PVC)/vinyl acetate copolymers, acid/acrylate modified ethylene vinyl acetate (EVA), and acid/anhydride-modified polyethylene.

Ink Retention System

Ink retention system 14 may include components in an ink retention coating 19 such as that disclosed in co-pending, co-assigned U.S. patent application Ser. Nos. 08/892,902 (Waller et al); 09/099,961 (Waller et al.); 09/099,956 (Waller et al.); and 09/550,496 (Ali et al.). Some ink has a very low surface tension, thus, the porous surface does not require the use of a surfactant, though a surfactant may still be used as an aid. In some applications, a surfactant may be utilized to provide particularly suitable surfaces for the particular ink components of the inkjet inks being used. Surfactants that may be suitable in some applications include cationic surfactants, anionic surfactants, nonionic surfactants, and zwitterionic surfactants. Many of each type of surfactant are commercially available. Accordingly, any surfactant or combination of surfactants of polymer(s) that will render porous structure 15 hydrophilic can be employed.

These surfactants can be imbibed into recessed surfaces of porous structure 15. Various types of surfactants may be utilized. Examples of surfactants which may be suitable in some applications include, but are not limited to, fluorochemical, silicon and hydrocarbon-based ones wherein the surfactants may be cationic, anionic or nonionic Furthermore, the nonionic surfactant may be used either as it is or in combination with another anionic surfactant in an organic solvent or in a mixture of water and organic solvent, the organic solvents usually being selected from the group of alcohol's.

Various types of non-ionic surfactants can be used, including but not limited to: Dupont's Zonyl fluorocarbons (e.g., Zonyl FSO); 3M's FC-170 or 171 surfactants; BASF's (PLURONIC) block copolymers of ethylene and propylene oxide to an ethylene glycol base; ICI's (TWEEN) polyoxyethylene sorbitan fatty acid esters; Rohm and Haas's (TRITON X series) octylphenoxy polyethoxy ethanol; Air Products and Chemicals, Inc., (SURFYNOL) tetramethyl decynediol; and Union Carbide's SILWET L-7614 and L-7607 silicon surfactants and the like. Various types of hydrocarbon-based anionic surfactants can also be used, including but not limited to: American Cyanamid's (AEROSOL OT) surfactants like dioctylsulfosuccinate-Na-salt or dialkylsulfosuccinate-Na-salt. Various types of cationic surfactants can also be used, including, but not limited to: benzalkonium chloride, a typical quaternary ammonium salt.

In a particularly preferred embodiment, ink retention system includes the terpolymer Poly[(vinylpyrrolidone)$_x$ (Acrylic Acid)$_y$(Dimethyl-aminoethylmethacrlate methyl chloride)$_z$] P(NVP/AA/DMAEMA $CH_3Cl^-$). The presently preferred ratio of the polymer is X=48.75%, Y=16.25%, and Z=35%. Other nonlimiting examples of polymers with a quaternary amine functional group that are useful include P(NVP/AA/DMAEA-$CH_3$C1), P(NVP/AA/DMAEMA-BenzylC1), P(NVP/AA/DMAEMA-$C_{16}H_{33}$Br). Inkjet dye inks do form a more stable relationship with polymers that have quaternary amine functional groups and when they are used in conjunction with zeolite or similar particles that are predisposed in the porous surface and after the membrane is thermally fused. The stable relationship means the colorant is fixed in the dense polymer from external forces such as the heat and pressure during the fusing step, ink migration or bleeding from water challenges after fusing, or ink feathering during the inkjet printing process. Inkjet ink to be jetted is by necessity somewhat low in viscosity and if a stable relationship is not maintained the ink can squirt from its intended image location from applied heat and pressure especially for the dye inks when no dry time after printing is allowed.

In accompaniment to this ingredient, other active ingredients of the ink retention system may include drying agents, flocculating agents, and surfactants. The use of flocculating agents (multivalent cations) in the Ink Retention Coating 19 should preferably be kept to a minimum as they will keep pigmented ink closer to the surface making it harder to seal all the ink. Hence, the resulting poor optical density from having the ink embedded in the porous matrix surprisingly is actually desirable because the optical density is enhanced from the fusing step.

By necessity, inkjet ink also contains a fair amount of humectants to prevent the print head nozzles from clogging or drying out. After printing, heavily inked areas of a graphic can have a tacky or greasy feel that can be called nap. Specifically, "dry to the touch" means an indistinguishable "feel" between the imaged and unimaged areas of the printing surface regardless of whether all volatile components of the ink have evaporated from the imaged area. The nappy feel can be controlled by the use of drying agents, which chemically or physicochemically eliminate the nap that is most likely caused from the humectants or other slow drying ingredients. This problem is less prevalent when the ink is allowed to fully penetrate the porous matrix. One aspect of the present invention requires the use of quaternary polymers and that may necessitate the use of a drying agent comprising an aromatic or aliphatic acid having sulfonic, carboxylic, phenolic or mixed functionalities thereof. The ink retention system may also include inactive agents without deviating from the spirit and scope of the present invention. Inactive imaging agents which may be suitable in some applications include dispersing agents, thermal stabilizers, anti-oxidants, anti-static, UV absorbers, biocides, fragrances, crosslinking agents and the like.

Crosslinking agents may be used to increase adhesion to the substrate, surface toughness, and chemical resistance. Many types of crosslinking agents are available such as melamine/formaldehyde resins, urea/formaldehyde resins, glyoxal resins, polyisocyanates, polyaziridines, polyepoxides, methylolated melamine/formaldehyde, and the like. A preferred crosslinking agent is an alkylated melamine formaldehyde resin sold as Cymel 370 or high imino melamine-formaldehyde resin sold as Cymel 327, both available from Cytec Industries Inc. The crosslinking agents are preferably used in amounts of less than 5% based on solution weight. If only hydroxyl groups are present or the primary film-forming polymer (porous matrix), adding a small amount of an acid catalyst such as Cycat 296-9, also available from Cytec Industries, is useful for the Cymel crosslinking agents. The solution vinyl resins with carboxyl or hydroxyl groups are particularly preferred for crosslinking sites and they have a stronger affinity towards alcohol non-solvent pore formers making casting solutions easier to phase separate.

Figure 4:
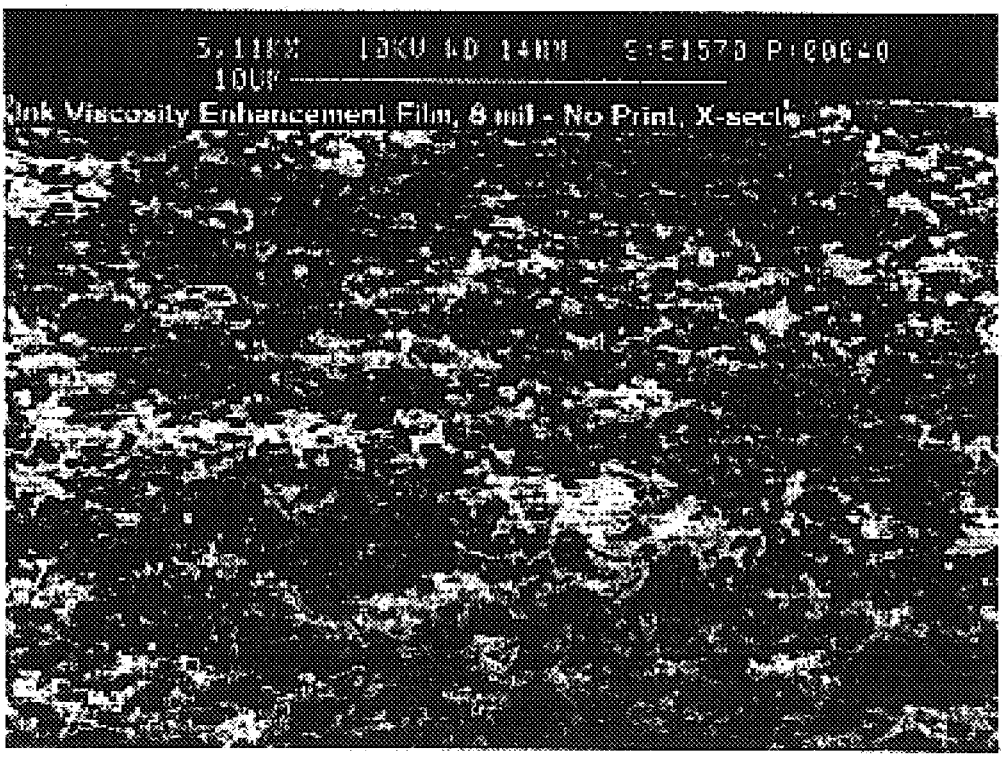
FIG. 4 is a micrograph of a structure in accordance with an exemplary embodiment of the present invention, in this figure the structure is magnified about 5000 times.
Figure 5:
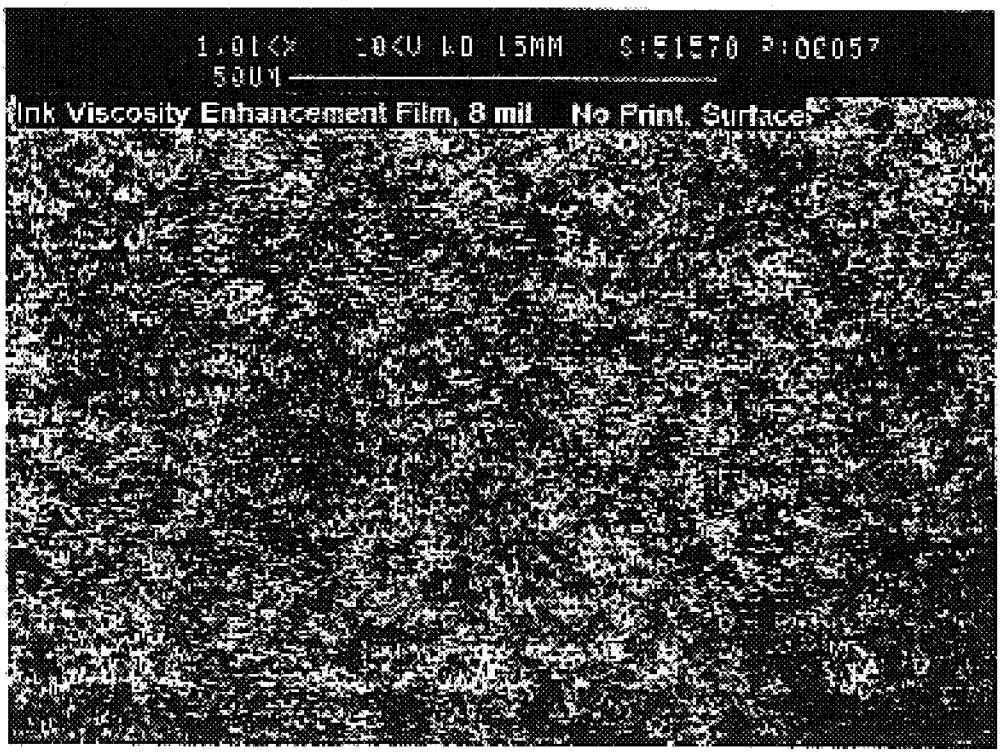
FIG. 5 is a micrograph of a structure in accordance with an exemplary embodiment of the present invention, in this figure the structure is magnified about 1000 times.

FIGS. 4 and 5 are scanning electron microscopic (SEM) photographs of an additional embodiment of a porous structure. In FIGS. 4 and 5 it may be noted that a plurality of pores are formed by the porous structure. It may be noted that the porous structure of FIGS. 4 and 5 does not include particles.

Figure 6:
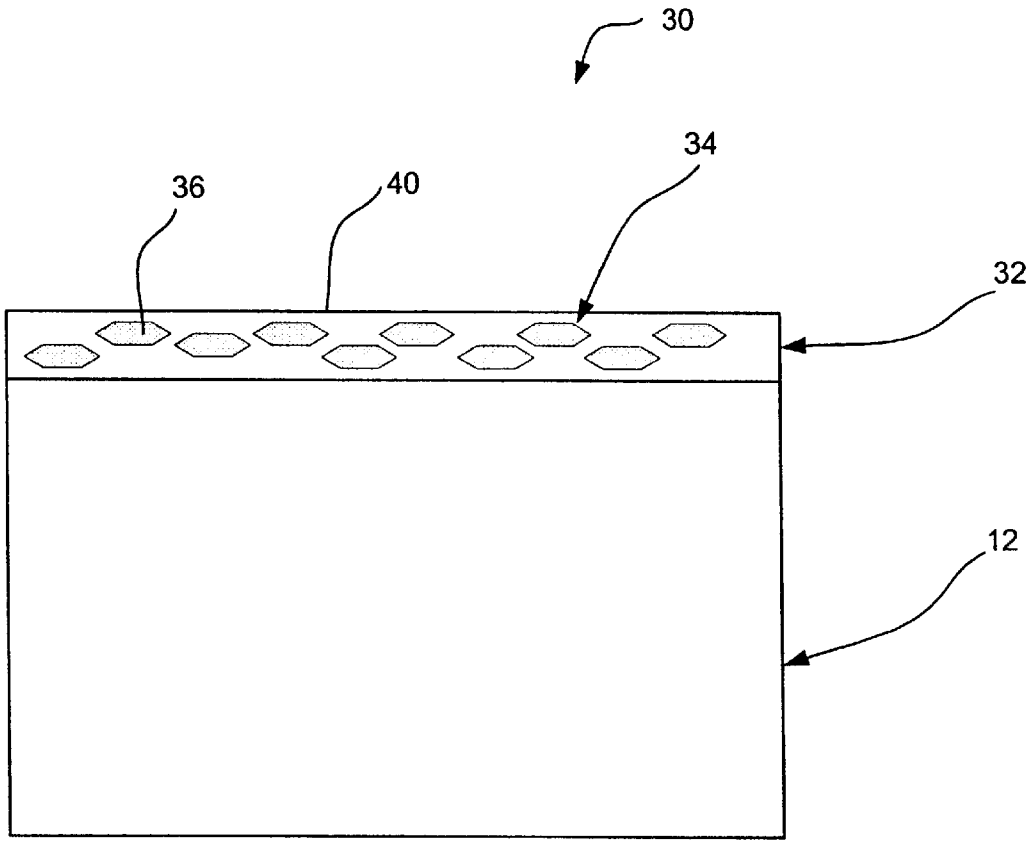
FIG. 6 is a highly diagrammatic cross-sectional view of a multi-layered structure in accordance with the present invention.

FIG. 6 is a highly diagrammatic cross-sectional view of a multi-layered structure 30 in accordance with the present invention. Multi-layered structure 30 comprises an ink retaining layer 32 overlaying a substrate 12. Ink retaining layer 32 defines a plurality of open cells 34, and a top surface 40. A quantity of ink 36 is disposed in a plurality of cells 34. Some of the cells 34 may also be substantially empty without deviating from the spirit and scope of the present invention. In some applications, it may be desirable to bond an overlayer to top surface 40 of ink retaining layer 32.

In a method in accordance with the present invention, an image comprising ink 36 may be applied to a porous structure, and the ink 36 may penetrate the pores of the porous structure. Pressure and/or heat may be applied to the porous structure to form cells 34 of ink retaining layer 32, thereby greatly reducing the thickness of layer 32. Hence, the layer is no longer porous and pigmented ink is essentially encapsulated. This method may be utilized to fabricate an identification card without an additional laminate.

In a preferred embodiment, ink 36 penetrates the pores of the porous structure to a depth which allows top surface 40 to close without ink being left on top surface 40 after the formation of cells 34. During the fabrication of multi-layered structure 30, the below the surface ink placement can be readily observed visually and can be measured utilizing an optical density measuring device.

Figure 7:
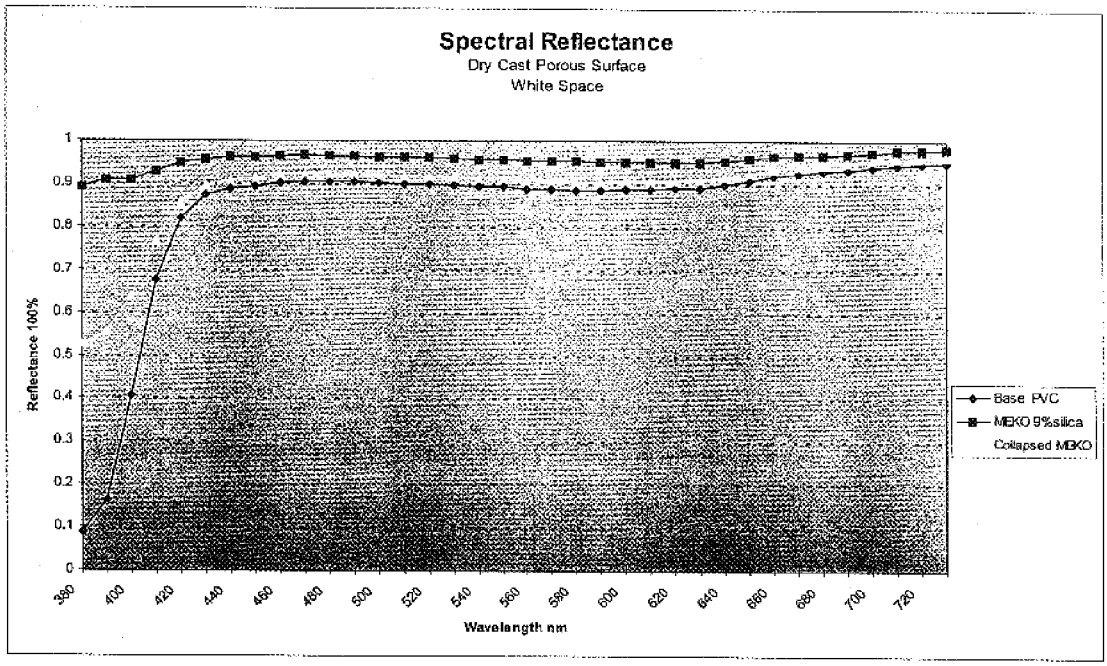
FIG. 7 is a graph of spectral reflectance values measured from a sample prepared as described in Example 11.

FIG. 7 is a graph of spectral reflectance values measured from a sample prepared as described in example 11. In FIG. 7, the top line (square data points) is the spectral reflectance of a sample after being heat fused and laminated. The middle line (triangle data points) is the spectral reflectance of the sample after being fused with heat and pressure. The bottom line (diamond data points) is the spectra reflectance of the base vinyl prior to coating. In FIG. 7 it may be appreciated that methods in accordance with the present invention may be utilized to alter the absorbtance/reflectance of a multi-layered structure in accordance with the present invention.

Figure 8:
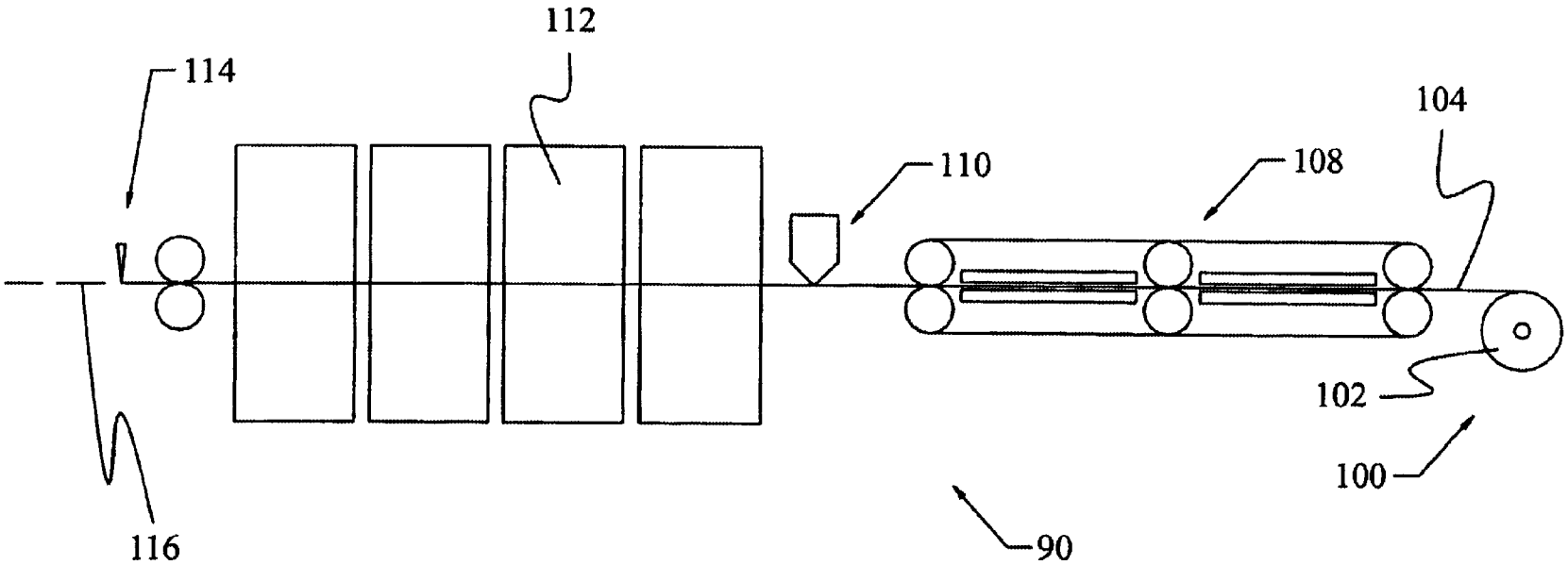
FIG. 8 is a diagrammatic representation of a dry cast production line in accordance with an exemplary embodiment of the present invention.

FIG. 8 is a diagrammatic representation of a dry cast production line 90 in accordance with an exemplary embodiment of the present invention. In FIG. 8, a first unwind station 100 is illustrated. First unwind station 100 includes a first roll 102 comprising a plurality of turns of a substrate web 104. As shown in FIG. 8, substrate web 104 is unwound from first roll 102 and passes through a roll set remover 108. After passing through roll set remover 108, substrate web 104 passes through a coating station 110.

Coating station 110 applies a layer of casting dope to an upper surface of substrate web 104. To facilitate drying, substrate web 104, including the layer of casting dope, is fed through a plurality of drying ovens 112. After passing through the drying ovens, the substrate web enters a sheeting station 114 in which the web is cut into sheets 116.

The following examples further disclose embodiments of the invention.

EXAMPLE 1

A casting dope comprising the formula described in the table below was prepared.

| | |
|---|---|
| 6.5 parts | Poly(vinyl chloride-co-vinyl acetate) 90:10 ratio Mw 44,000 Tg 79° C. (Union Carbide, VYNS-3) |
| 5.5 parts | Poly(vinyl chloride-co-vinyl acetate-co-maleic acid) 86:13:1 ratio Mw 27,000 Tg 74° C. (Union Carbide, VMCH) |
| 4.0 parts | Zeolite (PQ Corporation, Advera 401P) |
| 7.0 parts | LUVICROSS M (BASF Corporation) |
| 42 parts | MEK |
| 10 parts | acetone |
| 36 parts | n-butanol |

The casting dope was cast (Dry Cast) at 254 micrometers wet thickness onto a 559 micrometer white PETG substrate moving at a speed of 3.048 meters per minute. The casting dope was applied by pouring onto the substrate and smoothing with a notch bar coating knife.

The material was dried by passing through an oven having several temperature zones. The first zone of the drying oven was off except for exhaust. Thus, the first zone of the drying oven was at about room temperature. The second and third oven zones were set at 49 degrees C. and 60 degrees C. respectively.

The porous structure of the sample was then imbibed with an ink retention system in accordance with the present invention. The imbibing formula of the ink retention system is listed in the table below:

| | |
|---|---|
| 7.25 parts | (PVP/AA/DMAEMA $CH_3Cl^-$) |
| 2.25 parts | Aluminum sulfate hydrate |
| 0.75 parts | Silwet L-7607 |
| 0.75 parts | 5-hydroxy-isophthalic acid |
| 36.50 parts | ethanol |
| 52.50 parts | water |

The solution was imbibed into the porous surface by flood coating the surface, then removing the excess fluid with a smooth glass bar. The ink retention system was then dried using a hot air gun.

The resulting porous structure imbibed with ink retention system is pictured in FIG. 2 and FIG. 3.

EXAMPLE 2

A liquid solution comprising the formula described in the table below was prepared:

| | |
|---|---|
| 6.5 parts | Poly(vinyl chloride-co-vinyl acetate) 90:10 ratio Mw 44,000 Tg 79° C. (Union Carbide, VYNS-3) |
| 5.5 parts | Poly(vinyl chloride-co-vinyl acetate-co-maleic acid) 86:13:1 ratio Mw 27,000 Tg 74° C. (Union Carbide, VMCH) |
| 52 parts | MEK |
| 10 parts | acetone |
| 36 parts | n-butanol |

The resulting porous structure is pictured in FIG. 4 and FIG. 5.

This method enabled the screen-printing film to become an inkjet receptive film suitable for graphic applications.

EXAMPLE 3

A casting dope comprising the formula described in the table below was prepared.

| | |
|---|---|
| 6.5 parts | Poly(vinyl chloride-co-vinyl acetate) 90:10 ratio Mw 44,000 Tg 79° C. (Union Carbide, VYNS-3) |
| 5.5 parts | Poly(vinyl chloride-co-vinyl acetate-co-maleic acid) 86:13:1 ratio Mw 27,000 Tg 74° C. (Union Carbide, VMCH) |
| 4.0 parts | zeolite (PQ Corporation, Advera 401P) |
| 7.0 parts | LUVICROSS M (BASF Corporation) |
| 42 parts | MEK |
| 10 parts | acetone |
| 36 parts | n-butanol |

The casting dope was cast at 203.2 micrometers wet thickness onto a sheet of 3M #3540C screen printing film available from 3M Company, St. Paul, Minn. The casting dope was applied by pouring onto the substrate and smoothing with a notch bar coating knife. The material was then dried.

The porous structure of the sample was then imbibed with an ink retention coating in accordance with the present invention. The imbibing formula of the ink retention coating is listed in the table below:

| | |
|---|---|
| 7.25 parts | (PVP/AA/DMAEMA $CH_3Cl^-$) |
| 2.25 parts | Aluminum sulfate hydrate |
| 0.75 parts | Silwet L-7607 |
| 0.75 parts | 5-hydroxy-isophthalic acid |
| 36.50 parts | ethanol |
| 52.50 parts | water |

The solution was imbibed into the porous surface by flood coating the surface, then removing the excess fluid with a smooth glass bar. The ink retention coating was then dried using a hot air gun.

This method enabled the screen-printing film to become an aqueous inkjet receptive film suitable for graphic applications.

EXAMPLE 4

A casting dope comprising the formula described in the table below was prepared:

| | |
|---|---|
| 6.5 parts | Poly(vinyl chloride-co-vinyl acetate) 90:10 ratio Mw 44,000 Tg 79° C. (Union Carbide, VYNS-3) |
| 5.5 parts | Poly(vinyl chloride-co-vinyl acetate-co-maleic acid) 86:13:1 ratio Mw 27,000 Tg 74° C. (Union Carbide, VMCH) |
| 7.0 parts | LUVICROSS M (BASF Corporation) |
| 21.3 parts | ethanol |
| 65.7 parts | acetone |
| 1.0 parts | water |

A 96 mm×64 mm×559 micrometers thick PETG card was Dry Cast with a wet thickness of 190.5 micrometers of the above formula. The thickness was set with shims, and a smooth glass rod was used to strike off the excess solution. The surface was allowed to air dry for 30 seconds before hot air was applied to drive off the solvents and non-solvents of the coating system.

The porous structure of the sample was then imbibed with an ink retention coating in accordance with the present invention. The imbibing formula of the ink retention coating is listed in the table below:

| | |
|---|---|
| 7.25 parts | (PVP/AA/DMAEMA $CH_3Cl^-$) |
| 2.25 parts | Aluminum sulfate hydrate |
| 0.75 parts | Silwet L-7607 |
| 0.75 parts | 5-hydroxy-isophthalic acid |
| 36.50 parts | ethanol |
| 52.50 parts | water |

The solution was imbibed into the porous surface by flood coating the surface, then removing the excess fluid with a smooth glass bar. The ink retention coating was then dried using a hot air gun.

An identification card image was then printed onto the sample card with an Epson Stylus 750 inkjet printer. The printed image included a photo quality picture of a human face, a representation of fingerprint, and text. After printing, the identification card was heated with a hot air gun for 15 seconds just after printing. The printed image was visually inspected. The printed image was deemed to be sharp and substantially free of defects.

The product was placed together with a polyvinyl chloride-co-vinyl acetate (PVC/VA) sheet temporarily fixed to a polyester liner. The imaged porous layer was arranged to face the PVC/VA sheet. The thickness of the PVC/VA sheet was 0.3 mil (7.62 micrometers). A relatively thin PVC/VA sheet was utilized in order to facilitate subsequent water challenge testing on the sample. The thickness of the PVC/VA sheet was chosen for water permeation testing, so water permeated in a relatively short time.

The assembly was then laminated utilizing a thermal laminator system (3M model 5560M). The assembly was placed in a protective jacket supplied with the jacket prior to passing through the laminator. The 3M model 5560M laminator includes two heat zones. The first heat zone of the laminator was set to a temperature of 138 degrees C. The second heat zone of the laminator was set to a temperature of 160 degrees C.

The result of the laminating process was a flat laying sharply imaged identification card. The laminate bond was sufficiently strong to make the identification card substantially tamper resistant. The thermal bond was strong enough to withstand flexing and folding of the card without any delaminating.

The sample identification card was then subjected to a water challenge test. During the water challenge test, the sample identification card was immersed in water for 24 hours.

After the water challenge test the sample identification card was visually inspected. It was noted that ink migration had occurred during the water challenge test. The printed image of the sample identification card displayed substantial bleeding and feathering.

EXAMPLE 5

A casting dope comprising the formula described in the table below was prepared:

| | |
|---|---|
| 6.5 parts | Poly(vinyl chloride-co-vinyl acetate) 90:10 ratio Mw 44,000 Tg 79° C. (Union Carbide, VYNS-3) |
| 5.5 parts | Poly(vinyl chloride-co-vinyl acetate-co-maleic acid) 86:13:1 ratio Mw 27,000 Tg 74° C. (Union Carbide, VMCH) |
| 8.0 parts | zeolite (PQ Corporation, Advera 401P) |
| 65.7 parts | acetone |
| 21.3 parts | ethanol |
| 1.0 parts | water |

A 96 mm×64 mm×559 micrometers thick PETG card was Dry Cast with a wet thickness of 190.5 micrometers of the above formula. The thickness was set with shims, and a smooth glass rod was used to strike off the excess solution. The surface was allowed to air dry for 30 seconds before hot air was applied to drive off the solvents and non-solvents of the coating system.

An identification card image was then printed onto the sample card with an Epson Stylus 750 inkjet printer. The printed image included a photo quality picture of a human face, a representation of fingerprint, and text. After printing, the identification card was heated with a hot air gun for 15 seconds just after printing. The printed image was visually inspected. The printed image was of lesser quality.

The product was placed together with a polyvinyl chloride-co-vinyl acetate (PVC/VA) sheet temporarily fixed to a polyester liner. The imaged porous layer was arranged to face the PVC/VA sheet. The thickness of the PVC/VA sheet was 7.62 micrometers. A relatively thin PVC/VA sheet was utilized in order to facilitate subsequent water challenge testing on the sample.

The assembly was then laminated utilizing a thermal laminator system (3M model 5560M). The assembly was placed in a protective jacket supplied with the jacket prior to passing through the laminator. The 3M model 5560M laminator includes two heat zones. The first heat zone of the laminator was set to a temperature of 138 degrees C. The second heat zone of the laminator was set to a temperature of 160 degrees C.

The result of the laminating process was a flat laying, imaged identification card. The laminate bond was sufficiently strong to make the identification card substantially tamper resistant. The thermal bond was strong enough to withstand flexing and folding of the card without any delaminating.

The sample identification card was then subjected to a water challenge test. During the water challenge test, the sample identification card was immersed in water for 24 hours.

After the water challenge test the sample identification card was visually inspected. It was noted that ink migration had occurred during the water challenge test. The printed image of the sample identification card displayed substantial bleeding and feathering.

EXAMPLE 6

A casting dope comprising the formula described in the table below was prepared:

| | |
|---|---|
| 6.5 parts | Poly(vinyl chloride-co-vinyl acetate) 90:10 ratio Mw 44,000 Tg 79° C. (Union Carbide, VYNS-3) |
| 5.5 parts | Poly(vinyl chloride-co-vinyl acetate-co-maleic acid) 86:13:1 ratio Mw 27,000 Tg 74° C. (Union Carbide, VMCH) |
| 65.7 parts | acetone |
| 21.3 parts | ethanol |
| 1.0 parts | water |

A 96 mm×64 mm×559 micrometers thick PETG card was Dry Cast with a wet thickness of 190.5 micrometers of the above formula. The thickness was set with shims, and a smooth glass rod was used to strike off the excess solution. The surface was allowed to air dry for 30 seconds before hot air was applied to drive off the solvents and non-solvents of the coating system. The porous structure of the sample was then imbibed with ink retention coating in accordance with the present invention. The imbibing formula of the ink retention coating is listed in the table below:

| | |
|---|---|
| 7.25 parts | (PVP/AA/DMAEMA $CH_3Cl^-$) |
| 2.25 parts | Aluminum sulfate hydrate |
| 0.75 parts | Silwet L-7607 |
| 0.75 parts | 5-hydroxy-isophthalic acid |
| 36.50 parts | ethanol |
| 52.50 parts | water |

The solution was imbibed into the porous surface by flood coating the surface, then removing the excess fluid with a smooth glass bar. The ink retention coating was then dried using a hot air gun.

An identification card image was then printed onto the sample card with an Epson Stylus 750 inkjet printer. The printed image included a photo quality picture of a human face, a representation of fingerprint, and text. After printing, the identification card was heated with a hot air gun for 15 seconds just after printing. The printed image was visually inspected. The printed image was deemed to be sharp and substantially free of defects.

The product was placed together with a polyvinyl chloride-co-vinyl acetate (PVC/VA) sheet temporarily fixed to a polyester liner. The imaged porous layer was arranged to face the PVC/VA sheet. The thickness of the PVC/VA sheet was 7.62 micrometers. A relatively thin PVC/VA sheet was utilized in order to facilitate subsequent water challenge testing on the sample.

The assembly was then laminated utilizing a thermal laminator system (3M mode 5560M). The assembly was placed in a protective jacket supplied with the jacket prior to passing through the laminator. The 3M model 5560M laminator includes two heat zones The first heat zone of the laminator was set to a temperature of 138 degrees C. The second heat zone of the laminator was set to a temperature of 160 degrees C.

The result of the laminating process was a flat laying, sharply imaged identification card. The laminate bond was suffienctly strong to make the identification card substantially tamper resistant. The thermal bond was strong enough to withstand flexing and folding of the card without any delamination.

The sample identification card was then subjected to a water challenge test During the water challenge test, the sample identification card was immersed in water for 24 hours.

After the water challenge test the sample identification card was visually inspected It was noted that ink migration had occurred during the water challenge test. The printed image of the sample identification card displayed substantial bleeding and feathering.

EXAMPLE 7

A casting dope comprising the formula described in the table below was prepared:

| | |
|---|---|
| 6.5 parts | Poly(vinyl chloride-co-vinyl acetate) 90:10 ratio Mw 44,000 Tg 79° C. (Union Carbide, VYNS-3) |
| 5.5 parts | Poly(vinyl chloride-co-vinyl acetate-co-maleic acid) 86:13:1 ratio Mw 27,000 Tg 74° C. (Union Carbide, VMCH) |
| 8.0 parts | zeolite (PQ Corporation, Advera 401P) |
| 65.7 parts | acetone |
| 21.3 parts | ethanol |
| 1.0 parts | water |

A 96 mm×64 mm×559 micrometers thick PETG card was Dry Cast with a wet thickness of 190.5 micrometers of the above formula. The thickness was set with shims, and a smooth glass rod was used to strike off the excess solution. The surface was allowed to air dry for 30 seconds before hot air was applied to drive off the solvents and non-solvents of the coating system.

The porous structure of the sample was then imbibed with ink retention coating in accordance with the present invention. The imbibing formula of the ink retention coating is listed in the table below:

| | |
|---|---|
| 7.25 parts | (PVP/AA/DMAEMA $CH_3Cl^-$) |
| 2.25 parts | Aluminum sulfate hydrate |
| 0.75 parts | Silwet L-7607 |
| 0.75 parts | 5-hydroxy-isophthalic acid |
| 36.50 parts | ethanol |
| 52.50 parts | water |

The solution was imbibed into the porous surface by flood coating the surface, then removing the excess fluid with a smooth glass bar. The ink retention coating was then dried using a hot air gun.

An identification card image was then printed onto the sample card with an Epson Stylus 750 inkjet printer. The printed image included a photo quality picture of a human face, a representation of fingerprint, and text. After printing, the identification card was heated with a hot air gun for 15 seconds just after printing. The printed image was visually inspected. The printed image was deemed to be sharp and substantially free of defects.

The product was placed together with polyvinyl chloride-co-vinyl acetate (PVC/VA) sheet temporarily fixed to a polyester liner. The imaged porous layer was arranged to face the PVC/VA sheet. The thickness of the PVC/VA sheet was 7.62 micrometers. A relatively thin PVC/VA sheet was utilized in order to facilitate subsequent water challenge testing on the sample.

The assembly was then laminated utilizing a thermal laminator system (3M model 5560M). The assembly was placed in a protective jacket supplied with the jacket prior to passing through the laminator. The 3M model 5560M laminator includes two heat zones. The first heat zone of the laminator was set to a temperature of 138 degrees C. The second heat zone of the laminator was set to a temperature of 160 degrees C.

The result of the laminating process was a flat laying sharply imaged identification card. The laminate bond was sufficiently strong to make the identification card substantially tamper resistant. The thermal bond was strong enough to withstand flexing and folding of the card without any delamination.

The sample identification card was then subjected to a water challenge test. During the water challenge test, the sample identification card was immersed in water for 24 hours.

After the water challenge test the sample identification card was visually inspected. It was noted that no ink migration had occurred during the water challenge test. The printed image of the sample identification card displayed no bleeding and no feathering.

EXAMPLE 8

A casting dope comprising the formula described in the table below was prepared:

| | |
|---|---|
| 6.5 parts | Poly(vinyl chloride-co-vinyl acetate) 90:10 ratio Mw 44,000 Tg 79° C. (Union Carbide, VYNS-3) |
| 7.0 parts | Poly(vinyl chloride-co-vinyl acetate-co-maleic acid) 86:13:1 ratio Mw 27,000 Tg 74° C. (Union Carbide, VMCH) |
| 6.0 parts | zeolite (PQ Corporation, Advera 401P) |
| 6.0 parts | LUVICROSS M (BASF Corporation) |
| 25 parts | MEK |
| 25 parts | acetone |
| 20 parts | n-butanol |
| 19.6 parts | 4-methyl-2-pentanol |
| 1.0 parts | VITEL 2200B |

A vinyl 96 mm×64 mm×559 micrometers thick card was Dry Cast with a wet thickness of 254 micrometers of the above formula. The depth was set with shims and a smooth glass rod was used to strike off the excess solution. The surface was allowed to air dry for 30 seconds before hot air was applied to drive off the solvents and non-solvents of the casting dope.

The sample was then imaged with a Hewlett Packard 1120 inkjet printer containing pigmented ink. The imaged card was air dried for 15 seconds after printing. The imaged card was then placed in an Alantek model CL-99 cavity card laminator. The temperature of the laminator was set at 9 and the cooling was set at 4.

The result was a flat laying, sharply imaged card. The thermal bond of the now dense layer was found to be strong enough to withstand flexing and folding of the card until the vinyl card showed visible signs of stress fracture without delaminating.

It should be noted that in this example, the porous structure was not imbibed with ink retention coating prior to printing. In this example, the porous structure was collapsed with heat and pressure from the card laminator, sealing the printed image in the polymer to produce an imaged card, which is tamper and scuff resistant and water-fast.

EXAMPLE 9

A casting dope comprising the formula described in the table below was prepared:

| | |
|---|---|
| 5.5 parts | Poly(vinyl chloride-co-vinyl acetate) 90:10 ratio Mw 44,000 Tg 79° C. (Union Carbide, VYNS-3) |
| 6.5 parts | Poly(vinyl chloride-co-vinyl acetate-co-maleic acid) 86:13:1 ratio Mw 27,000 Tg 74° C. (Union Carbide, VMCH) |
| 6.0 parts | zeolite (PQ Corporation, Advera 401P) |
| 6.0 parts | LUVICROSS M (BASF Corporation) |
| 32.5 parts | MEK |
| 25 parts | acetone |
| 27.5 parts | n-butanol |
| 10.0 parts | 4-methyl-2-pentanol |
| 3.0 parts | VITEL 2200B |

A vinyl 96 mm×64 mm×559 micrometers thick card was Dry Cast with a wet thickness of 254 micrometers of the above formula. The depth was set with shims and a smooth glass rod was used to strike off the excess solution. The surface was allowed to air dry for 30 seconds before hot air was applied to drive off the solvents and non-solvents of the casting dope. Seven parts of the MEK were added in solution with the 3.0 parts of VITEL 2200B.

EXAMPLE 10

A casting dope comprising the formula described in the table below was prepared:

| | |
|---|---|
| 5.5 parts | Poly(vinyl chloride-co-vinyl acetate) 90:10 ratio Mw 44,000 Tg 79° C. (Union Carbide, VYNS-3) |
| 6.5 parts | Poly(vinyl chloride-co-vinyl acetate-co-maleic acid) 86:13:1 ratio Mw 27,000 Tg 74° C. (Union Carbide, VMCH) |
| 9.0 parts | precipitated silica (Degussa Corp.) |
| 36.2 parts | MEK |
| 25.5 parts | acetone |
| 25.0 parts | n-butanol |
| 12.5 parts | 4-methyl-2-pentanol |
| 1.8 parts | VITEL 2200B |

A vinyl 96 mm×64 mm×559 micrometers thick card was Dry Cast with a wet thickness of 254 micrometers of the above formula. The depth was set with shims and a smooth glass rod was used to strike off the excess solution. The surface was allowed to air dry for 30 seconds before hot air was applied to drive off the solvents and non-solvents of the casting dope.

The sample was then imaged with a Hewlett Packard 1120 inkjet printer containing pigmented ink. The imaged card was air dried for 15 seconds after printing. The imaged card was then placed in an Alantek model CL-99 cavity card laminator. The temperature of the laminator was set at 9 and the cooling was set at 4.

EXAMPLE 11

A casting dope comprising the formula described in the table below was prepared:

| | |
|---|---|
| 5.5 parts | Poly(vinyl chloride-co-vinyl acetate) 90:10 ratio Mw 44,000 Tg 79° C. (Union Carbide, VYNS-3) |
| 6.5 parts | Poly(vinyl chloride-co-vinyl acetate-co-maleic acid) 86:13:1 ratio Mw 27,000 Tg 74° C. (Union Carbide, VMCH) |
| 6.0 parts | zeolite (PQ Corporation, Advera 401P) |
| 6.0 parts | LUVICROSS M (BASF Corporation) |
| 32.5 parts | MEK |
| 25 parts | acetone |
| 27.5 parts | n-butanol |
| 10.0 parts | 4-methyl-2-pentanol |
| 3.0 parts | VITEL 2200B |

A vinyl 96 mm×64 mm×559 micrometers thick card was Dry Cast with a wet thickness of 254 micrometers of the above formula. The depth was set with shims and a smooth glass rod was used to strike off the excess solution. The surface was allowed to air dry for 30 seconds before hot air was applied to drive off the solvents and non-solvents of the casting dope. Seven parts of the MEK were added in solution with the 3.0 parts of VITEL 2200B.

The resulting porous structure was imaged with a Hewlett Packard model HP 120 inkjet printer utilizing pigmented ink. The optical density of the resulting image was measured utilizing a Gretag SPM 50 spectrophotometer set at D65 light, 2° observer angle DIN standard, and no filter disk. The resulting measurements are shown in the first row of the table below.

Heat and pressure was then applied to the multi-layered structure utilizing are Interlock Cardjet laminator having TEFLON coated aluminum plates. The laminator settings were 160° C. and a 6-second dwell time at a pressure of 800 Kg. After the application of heat and pressure the optical density of the image was measured utilizing a Gretag SPM 50 spectrophotometer set at D65 light, 2° observer angle, DIN standard, and no filter disk. The resulting measurements are shown in the second row of the table below.

An overlayer of polyvinyl chloride-co-vinyl acetate (PVCNA) on a polyester linen was then laminated to the ink-retaining layer of the multi-layered structure. The overlayer and the multi-layered structure were arranged so that the PVC/VA material faced the image-retaining layer. The assembly was then placed in the protective jacket of a 3M model 5560M thermal laminator system. The multi-layered structure was then passed through the laminator. The temperatures of the two heat zones of the laminator were set at 138° C. and 160° C. The polyester release liner was then removed, and the optical density of the image was measured. The optical density of the image was measured utilizing a Gretag SPM 50 spectrophotometer set at D65 light, 20 observer angle, DIN standard, and no filter disk. The resulting measurements are shown in the second row of the table below.

| MEASUREMENT | K | CYM | C | Y | M | R | G | B |
|---|---|---|---|---|---|---|---|---|
| as printed [wave length at highest density] | 1.17 | 1.17 | 0.86 | 0.86 | 0.89 | [420] 0.81 | [420] 0.75 | [620] 0.84 |
| Heat Fused | 1.52 | 1.58 | 1.16 | 1.46 | 1.16 | [430] 1.51 | [420] 1.48 | [610] 1.48 |

-continued

| MEASUREMENT | K | CYM | C | Y | M | R | G | B |
|---|---|---|---|---|---|---|---|---|
| Heat fused and then laminated | 2.44 | 2.38 | 1.27 | 1.92 | 1.27 | [430] 1.74 | [420] 1.95 | [620] 2.00 |

Measured Optical Densities

As described previously absorbtance (optical density) is the ratio of the radiant energy absorbed by a body that is incident upon it. The mathematical expression for absorbtance may be written $$A=-Log_{10}(I_R/I_S)$$

Where $I_R$ is the intensity of light transmitted from the object and $I_S$ is the intensity of the source light. The value measured from the "as printed" sample for the blue color in the table above is 0.84. This absorbtance value may be inserted into the mathematical expression above along with a value 100% for $I_S$ to yield a value of 14.45% for $I_R$.

The value measured from the "heat fused" sample for the blue color in the table above is 1.48. This absorbtance value may be inserted into the mathematical expression above along with a value 100% for $I_S$ to yield a value of 3.31% for $I_R$.

The value measured from the "heat fused then laminated" sample for the blue color in the table above is 2.00. This absorbtance value may be inserted into the mathematical expression above along with a value 100% for $I_S$ to yield a value of 1.00% for $I_R$.

Hence, the adsorption would be 85.55% as printed, 96.69% after being head fused, and 99.00% after being heat fused and laminated resulting in deep rich colors that are desirable for graphics.

FIG. 7 is a graph of spectral reflectance values measured from a sample prepared as described in example 11. In FIG. 7, the top line (square data points) is the spectral reflectance of a sample after being heat fused and laminated. The middle line (triangle data points) is the spectral reflectance of the sample after being fused with heat and pressure. The bottom line (diamond data points) is the spectra reflectance of the base vinyl prior to coating. In FIG. 7 it may be appreciated that methods in accordance with the present invention may be utilized to alter the absorbtance/reflectance of a multi-layered structure in accordance with the present invention.

Samples which printed with pigment ink and fused in accordance with this example were tested for water resistance. Each sample was totally submerged in water for at least one week. The fused porous surfaces where found to be 100% waterproof. Another useful test is to use a wet, white, cloth or tissue and to rub the fused graphic to see if any color can be transferred to the cloth. Similarly, hand wipes loaded with isopropyl alcohol, such as Alcopad 806 by Cleantex, can be used to test the fastness of the pigments. Samples made in accordance with this invention also passed these tests with no visible color transfer to the wipes.

In a particularly preferred embodiment, the fusion of the porous surface is accomplished directly with a hot roller immediately after printing. Water present in the ink easily exits the porous matrix during the fusion process. Fusion with a protective jacket or platen plate may trap escaping gases causing image abnormalities. However, some slight drying before fusion can correct this. The temperature of the roll is preferred to be about 160° C. at a speed of 1 ft/min with a pressure of about 200-psi force applied to the surface. The time, temperature, and pressure can be varied to achieve the same sealing effect. The sealing roll's surface will transfer to the finished product. A coarse surface will render a matte finish where a polished roll will give a gloss finish. The sealing roll is best coated with Teflon, silicone rubber, or the like, to prevent sticking to the roll. Graphics, signs, banners, labels, ID cards are some of the envisioned products made using this invention.

EXAMPLE 12

A casting dope comprising the formula described in the table below was prepared:

| | |
|---|---|
| 7.0 parts | Poly(vinyl chloride-co-vinyl acetate) 90:10 ratio Mw 44,000 Tg 79° C. (Union Carbide, VYNS-3) |
| 5.0 parts | Poly(vinyl chloride-co-vinyl acetate-co-hydroxyalkyl acrylate) 81:4:15 ratio Mw 33,000 Tg 70° C. (Union Carbide, VAGF) |
| 5.0 parts | precipitated silica (Degussa Corp.) |
| 10.0 parts | MEK |
| 40.5 parts | acetone |
| 37.5 parts | n-butanol |
| .3 parts | Cycat 296-9 |
| 2.0 parts | Cymel 370 |
| 3.0 parts | VITEL 2700B |

A vinyl 96 mm×64 mm×762 micrometers thick card was Dry Cast with a wet thickness of 279 micrometers of the above formula. The depth was set with shims and a smooth glass rod was used to strike off the excess solution. The surface was allowed to air dry for 10 seconds with mild air impingement before hot air was applied to drive off the solvents and non-solvents of the casting dope. Seven parts of the MEK were added in solution with the 3.0 parts of VITEL 2700B.

EXAMPLE 13

A casting dope comprising the formula described in the table below was prepared:

| | |
|---|---|
| 7.0 parts | Poly(vinyl chloride-co-vinyl acetate) 90:10 ratio Mw 44,000 Tg 79° C. (Union Carbide, VYNS-3) |
| 5.0 parts | Poly(vinyl chloride-co-vinyl acetate-co-Hydroxyalkyl acrylate) 81:4:15 ratio Mw 33,000 Tg 70° C. (Union Carbide, VAGF) |
| 5.0 parts | Precipitated silica (Degussa Corp.) |
| 17.0 parts | MEK |
| 40.5 parts | Acetone |
| 37.5 parts | n-butanol |
| 3.0 parts | VITEL 2700B |

A vinyl 96 mm×64 mm×762 micrometers thick card was Dry Cast with a wet thickness of 279 micrometers of the above formula. The depth was set with shims and a smooth glass rod was used to strike off the excess solution. The surface was allowed to air dry for 10 seconds with mild air impingement before hot air was applied to drive off the solvents and non-solvents of the casting dope. The seven parts of the MEK were added in solution with the 3.0 parts of VITEL 2700B.

The resulting porous structure was then imaged with a Hewlett Packard model HP 1120 inkjet printer utilizing pigmented ink. Immediately after printing (as fast as humanly possible) the card was then inserted printed side face down in the laminating section of an Eltron Max 3000 laminator set at a speed of twelve inches per minute at 160° C. that was already warmed up and ready to go. The sealing operation took about 15 seconds. (The machine normally accepts oversized cards and then die cuts them to a normal credit card size after fusing. For machine compatibility reasons step this was allowed to happen. The machine also normally bonds two separate films together, but to demonstrate independent hot roll sealing, obviously the laminate was omitted.) The result was a flat lying, tamper resistant, durable, waterproof ID card all made in about 40 seconds from when the printer started printing.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. An imageable media comprising:

a substrate;

a porous layer overlaying the substrate, the porous layer comprising a plurality of particles; and an ink retention coating imbibed upon the porous layer, the ink retention coating comprising a terpolymer of vinylpyrrolidone, acrylic acid and dimethylaminoethyl methacrylate methyl chloride.

2. The imageable media of claim 1, further comprising an over-layer overlaying the ink retention coating.

3. The imageable media of claim 2, wherein the over-layer is optically transparent.

4. The imageable media of claim 1, wherein the particles within the porous layer comprises cross-linked polyvinylpyrrolidone particles.

5. The imageable media of claim 1, wherein the substrate comprises polyvinyl chloride.

6. The imageable media of claim 1, wherein the substrate comprises polyethylene terephthalate glycol.

7. The imageable media of claim 1, wherein the substrate includes a filler selected from the group consisting of silicates, aluminates, feldspar, talc, calcium carbonate, and titanium dioxide.

8. The imageable media of claim 2, further comprising a tie layer disposed between the ink retention coating and the over-layer.

9. The imageable media of claim 1, wherein the porous layer further comprises zeolite granules.

10. The imageable media of claim 1, wherein the porous layer comprises cross-linked polyvinylpyrrolidone particles and zeolite granules.

11. The imageable media of claim 1, wherein the terpolymer of vinylpyrrolidone, acrylic acid an dimethylaminoethyl methacrylate methyl chloride is formed from about 49 mole percent vinylpyrrolidone monomer, about 16 mole percent acrylic acid monomer, and about 35 mole percent dimethylaminoethyl methacrylate methyl chloride monomer.

12. An imageable media comprising:

a substrate;

a porous layer overlaying the substrate, the porous layer comprising poly(vinyl chloride-co-vinyl acetate) and poly(vinyl chloride-co-vinyl acetate-co-maleic acid);

a plurality of cross-linked polyvinylpyrrolidone particles dispersed within the porous layer;

a plurality of zeolite granules dispersed within the porous layer;

an ink retention coating imbibed upon the porous layer, the ink retention coating comprising a terpolymer of vinylpyrrolidone, crylic acid and dimethylaminoethyl methacrylate methyl chloride; and an over-layer overlaying the ink retention coating.

13. The imageable media of claim 12, wherein the over-layer is optically transparent.

14. The imageable media of claim 12, wherein the substrate comprises polyvinyl chloride.

15. The imageable media of claim 12, wherein the substrate comprises polyethylene terephthalate glycol.

16. The imageable media of claim 12, wherein the substrate includes a filler selected from the group consisting of silicates, aluminates, feldspar, talc, calcium carbonate, and titanium dioxide.

17. The imageable media of claim 12, further comprising a tie layer disposed between the ink retention coating and the over-layer.

18. The imageable media of claim 12, wherein the terpolymer of vinylpyrrolidone, acrylic acid an dimethylaminoethyl methacrylate methyl chloride is formed from about 49 mole percent vinylpyrrolidone monomer, about 16 mole percent acrylic acid monomer, and about 35 mole percent dimethylaminoethyl methacrylate methyl chloride monomer.

19. An imageable media comprising:

a substrate comprising one of polyvinyl chloride or polyethylene terephthalate glycol;

a porous layer overlaying the substrate, the porous layer comprising poly(vinyl chloride-co-vinyl acetate) and poly(vinyl chloride-co-vinyl acetate-co-maleic acid);

a plurality of cross-linked polyvinylpyrrolidone particles dispersed within the porous layer;

plurality of zeolite granules dispersed within the porous layer; and an ink retention coating imbibed upon the porous layer, the ink retention coating comprising a terpolymer of vinylpyrrolidone, acrylic acid and a quaternary amine monomer.

20. The imageable media of claim 19, wherein the quaternary amine monomer is selected from the group consisting of dimethylaminoethyl methacrylate methyl chloride, dimethylaminoethyl methacrylate benzyl chloride, and dimethylaminoethyl methacrylate $C_{16}H_{33}$ bromide.

21. The imageable media of claim 19, wherein the substrate includes a filler selected from the group consisting of silicates, aluminates, feldspar, talc, calcium carbonate, and titanium dioxide.

* * * * *

UNITED STATES PATENT AND TRADEMARK OFFICE

CERTIFICATE OF CORRECTION

PATENT NO. : 6,692,799 B2
DATED : February 17, 2004
INVENTOR(S) : Waller, Clinton P. Jr.

It is certified that error appears in the above-identified patent and that said Letters Patent is hereby corrected as shown below:

Column 6,
Line 28, delete “there” and insert -- then --.
Line 34, delete “doped” and insert -- dope --.
Line 39, after “metering” insert -- , --.
Line 43, after “atmosphere” insert -- . --.

Column 8,
Line 11, delete “of” and insert -- or --.
Line 16, after “particles” insert -- . --.
Line 21, after “silica” insert -- , --.
Line 24, insert -- , -- before “calcium silicate”.
Line 25, after “oxide” insert -- , --.
Line 27, after “hydroxide” insert -- , --.
Line 30, after “pigmentation” insert -- , --.
Line 40, after “dispersed” insert -- . --.

Column 10,
Line 49, delete “finctional” and insert -- functional --.

Column 11,
Line 25, delete “of” after “surfactants” and insert -- or --.

Column 12,
Line 53, delete “or” and insert -- on --.

Column 18,
Line 51, delete “mode” and insert -- model --.
Line 54, insert -- . -- before “The”.
Line 65, insert -- . --before “During”.

UNITED STATES PATENT AND TRADEMARK OFFICE

CERTIFICATE OF CORRECTION

PATENT NO. : 6,692,799 B2
DATED : February 17, 2004
INVENTOR(S) : Waller, Clinton P. Jr.

It is certified that error appears in the above-identified patent and that said Letters Patent is hereby corrected as shown below:

Column 19,
Line 2, after " inspected" insert -- . --.

Column 22,
Line 43, delete "(PVCNA)" and insert -- (PVC/VA) --.
Line 53, delete "20" and insert -- 2° --.

Column 25,
Line 63, delete "an" and insert -- and --.

Column 26,
Line 16, delete "crylic" and insert -- acrylic --.
Line 33, delete "an" and insert -- and --.
Line 48, insert -- a -- before "plurality".

Signed and Sealed this

Sixth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,692,799 B2
DATED : February 17, 2004
INVENTOR(S) : Waller, Clinton P. Jr.

It is certified that error appears in the above-identified patent and that said Letters Patent is hereby corrected as shown below:

Title page,
Insert Item:

-- [73] Assignee: 3M Innovative Properties Company --

Signed and Sealed this

Twelfth Day of October, 2004

JON W. DUDAS
*Director of the United States Patent and Trademark Office*